United States Patent [19]

David

[11] Patent Number: 4,665,703

[45] Date of Patent: May 19, 1987

[54] EXTERNAL COMBUSTION ENGINE WITH AIR-SUPPORTED FREE PISTON

[76] Inventor: Constant V. David, 4952 Field St., San Diego, Calif. 92110

[21] Appl. No.: 866,946

[22] Filed: May 27, 1986

Related U.S. Application Data

[63] Continuation-in-part of Ser. No. 789,451, Oct. 21, 1985, which is a continuation-in-part of Ser. No. 586,812, Mar. 6, 1984, Pat. No. 4,561,252.

[51] Int. Cl.[4] ..... F02B 71/04

[52] U.S. Cl. ..... 60/595; 123/46 R; 384/111

[58] Field of Search ..... 60/595; 123/46 R, 46 A; 384/99, 109, 111

[56] References Cited

U.S. PATENT DOCUMENTS

| | | | |
|---|---|---|---|
| 1,620,565 | 3/1927 | McKeown | 123/46 A |
| 1,858,102 | 5/1932 | McKeown | 123/46 A |
| 2,595,396 | 5/1952 | Lee | 60/595 X |
| 2,814,551 | 11/1957 | Broeze et al. | 123/46 A X |
| 2,943,610 | 7/1960 | Foster | 60/595 X |
| 3,339,670 | 9/1967 | McGrew, Jr. et al. | 418/99 X |
| 3,365,879 | 1/1968 | Panhard | 60/595 |
| 3,502,920 | 3/1970 | Chaboseau | 384/99 X |
| 3,643,638 | 2/1972 | Braun | 60/595 X |
| 4,541,243 | 9/1985 | Clark | 60/595 |

FOREIGN PATENT DOCUMENTS

| | | | |
|---|---|---|---|
| 208150 | 10/1924 | United Kingdom | 60/595 |

*Primary Examiner*—Michael Koczo

[57] ABSTRACT

An external combustion engine including a rotary motor providing the means for compressing air and expanding combusted gases, and an externally located combustion member in which fuel is burned. The combustion member comprises a sleeve and a free piston reciprocating therein, thereby forming combustion chambers between its two ends and the end closures of the sleeve, as it reaches the end of its stroke. The back and forth motion of the piston is independent of the rotation of the motor as these two components are not mechanically connected, having only ducting connections therebetween. The combustion member air admission, combusted gas exhaust, the fuel injection and the ignition are all timely controlled and activated as a result of the free piston motion and location in the sleeve. The fuel/air ratio is continuously monitored so as to prevent high combustion temperatures. During its reciprocating motion the piston is guided so that its axial displacement causes a concomitant oscillating rotational movement such that the resulting piston motion may be used to operate the combustion member without the use of either inlet or outlet valves. The piston is also supported during this motion by pressurized air cushions formed in association with a longitudinally oriented central hollow shaft extending between the sleeve end closures. Solid contacts between the piston and the sleeve and/or shaft are thus prevented while the engine operates, eliminating causes of wear and extraneous heat production, and thus the need of lubrication.

25 Claims, 19 Drawing Figures

FIG. 1
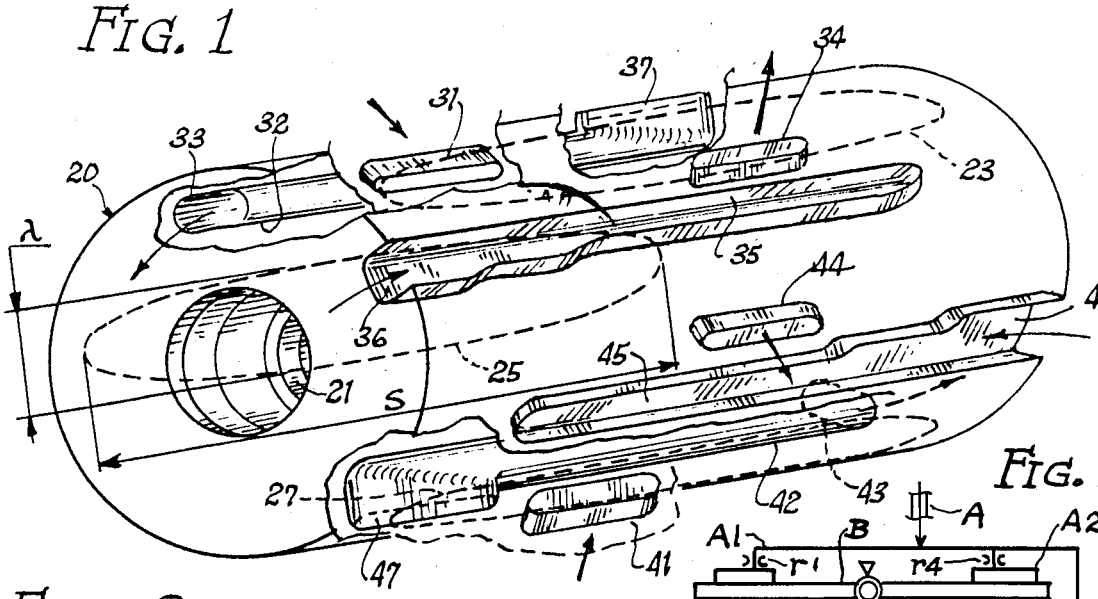
FIG. 18
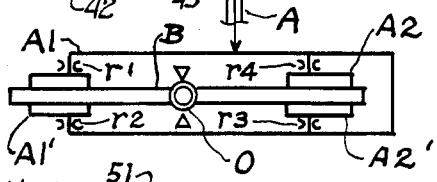
FIG. 2
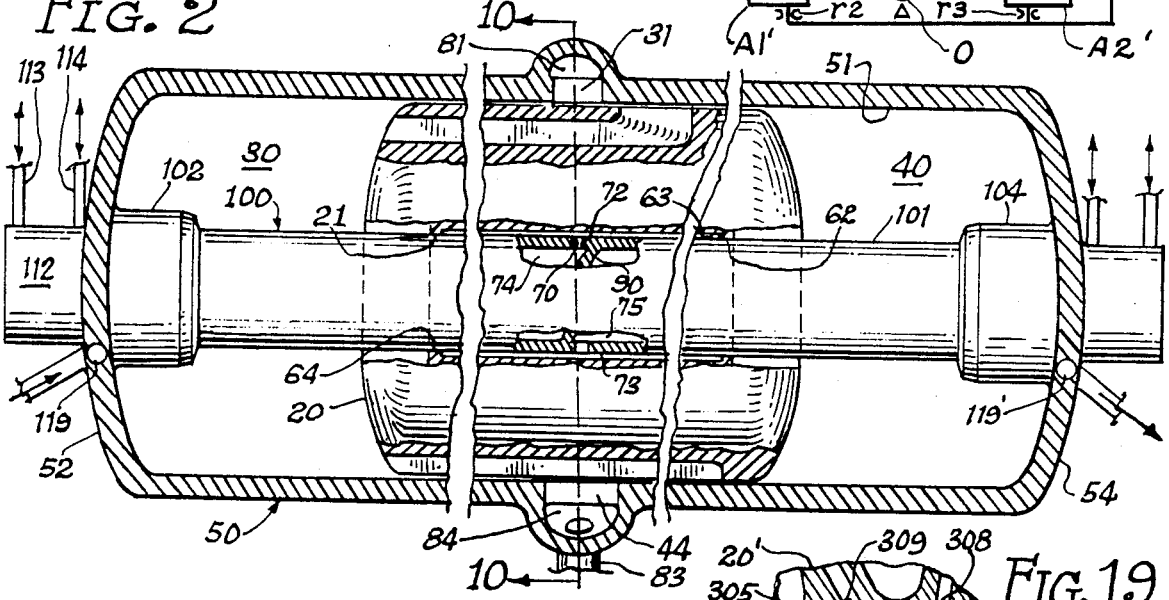
FIG. 19
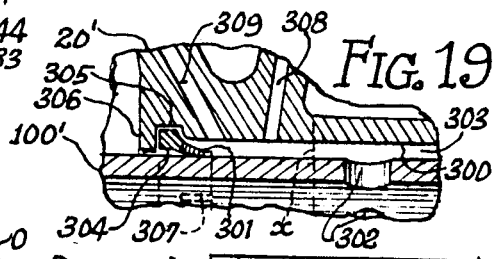
FIG. 3
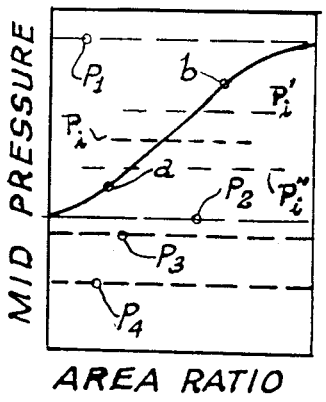
FIG. 4
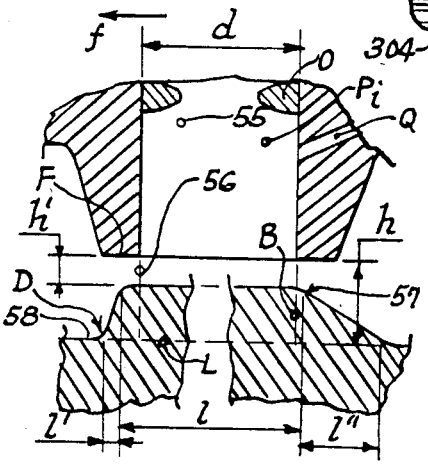
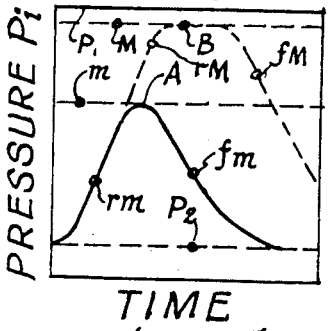
FIG. 5

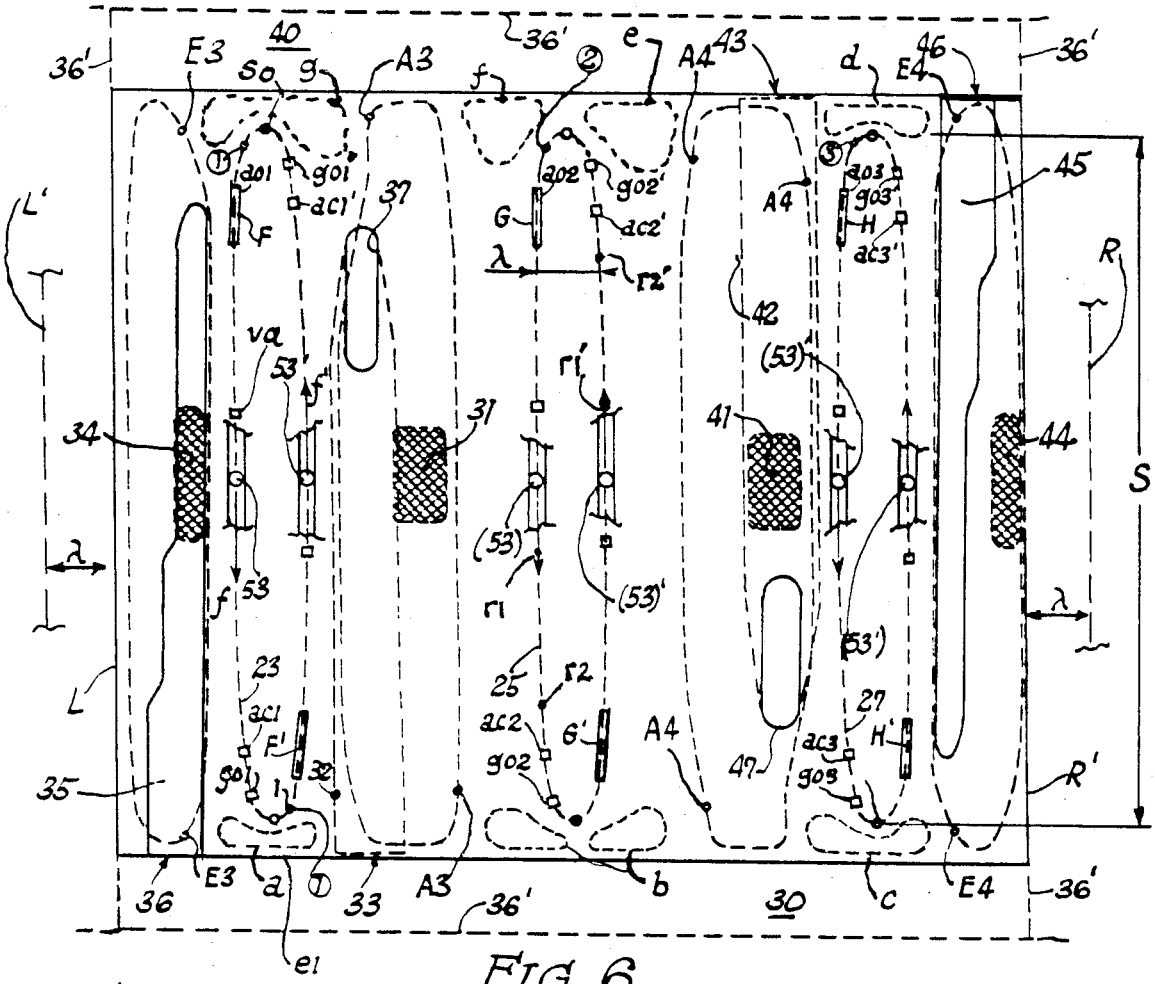
FIG. 6
FIG. 7
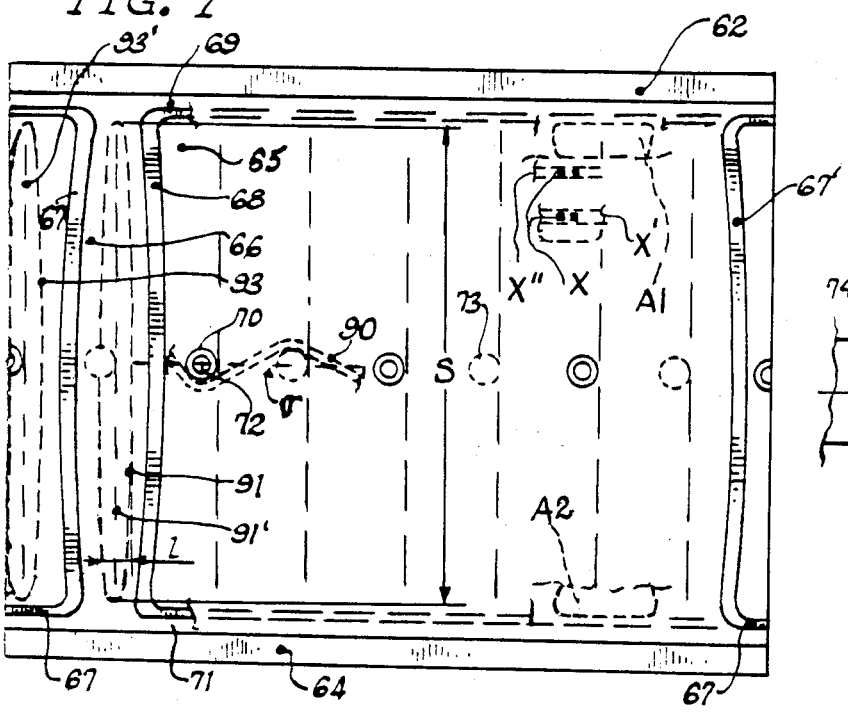
FIG. 9
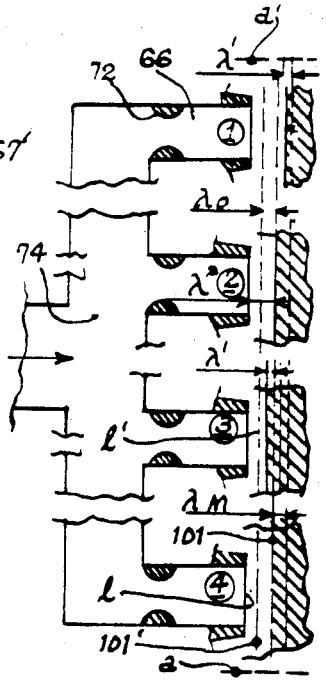

FIG. 10
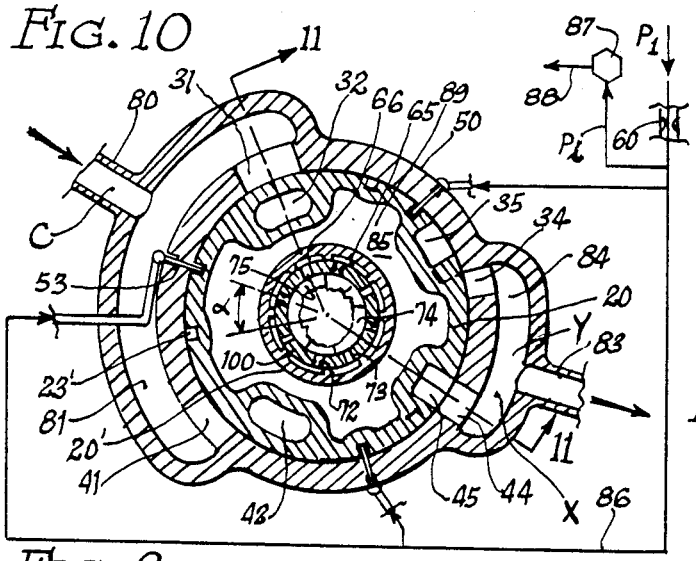
FIG. 16
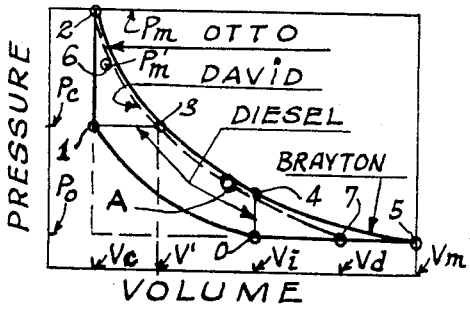
FIG. 8
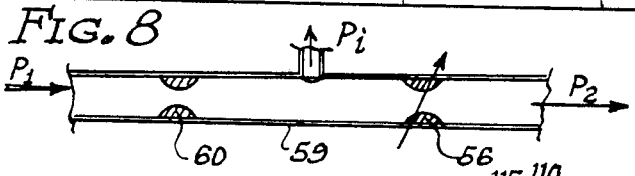
FIG. 12
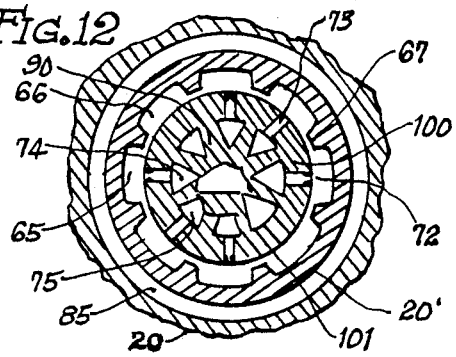
FIG. 13
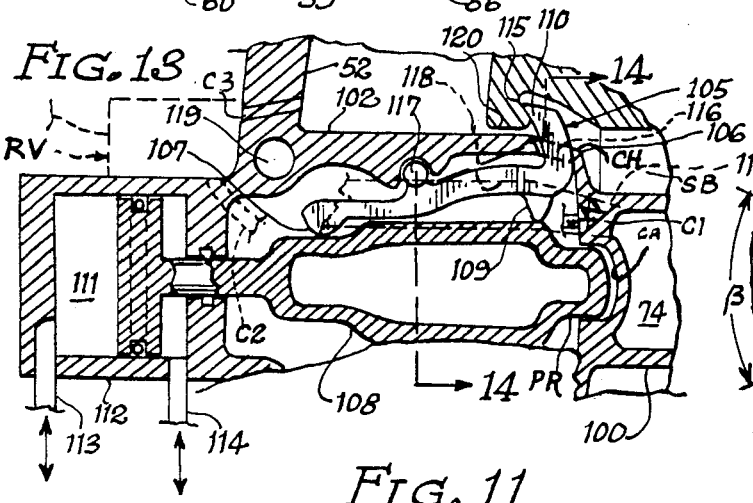
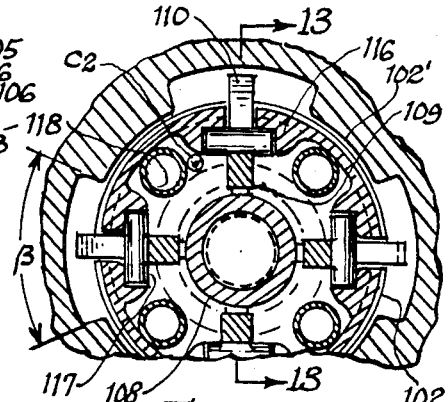
FIG. 14
FIG. 11
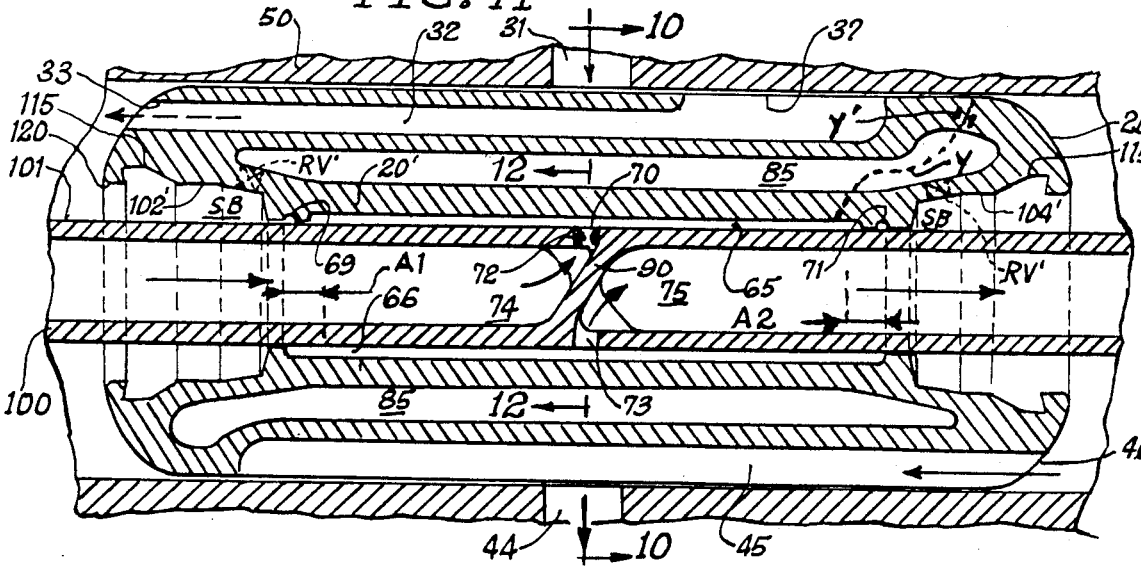

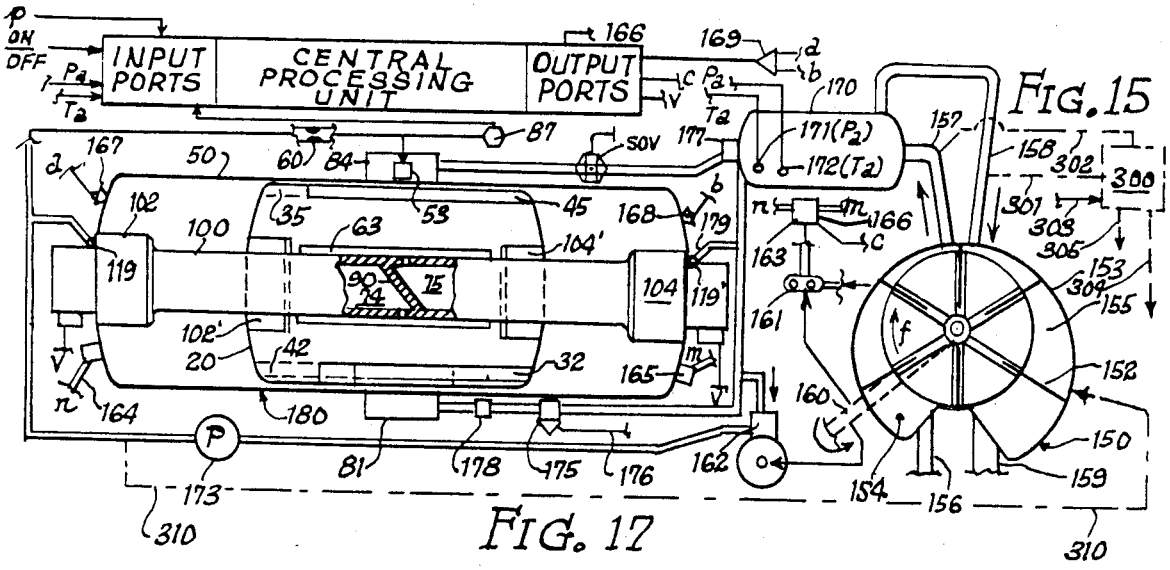
FIG. 15
FIG. 17
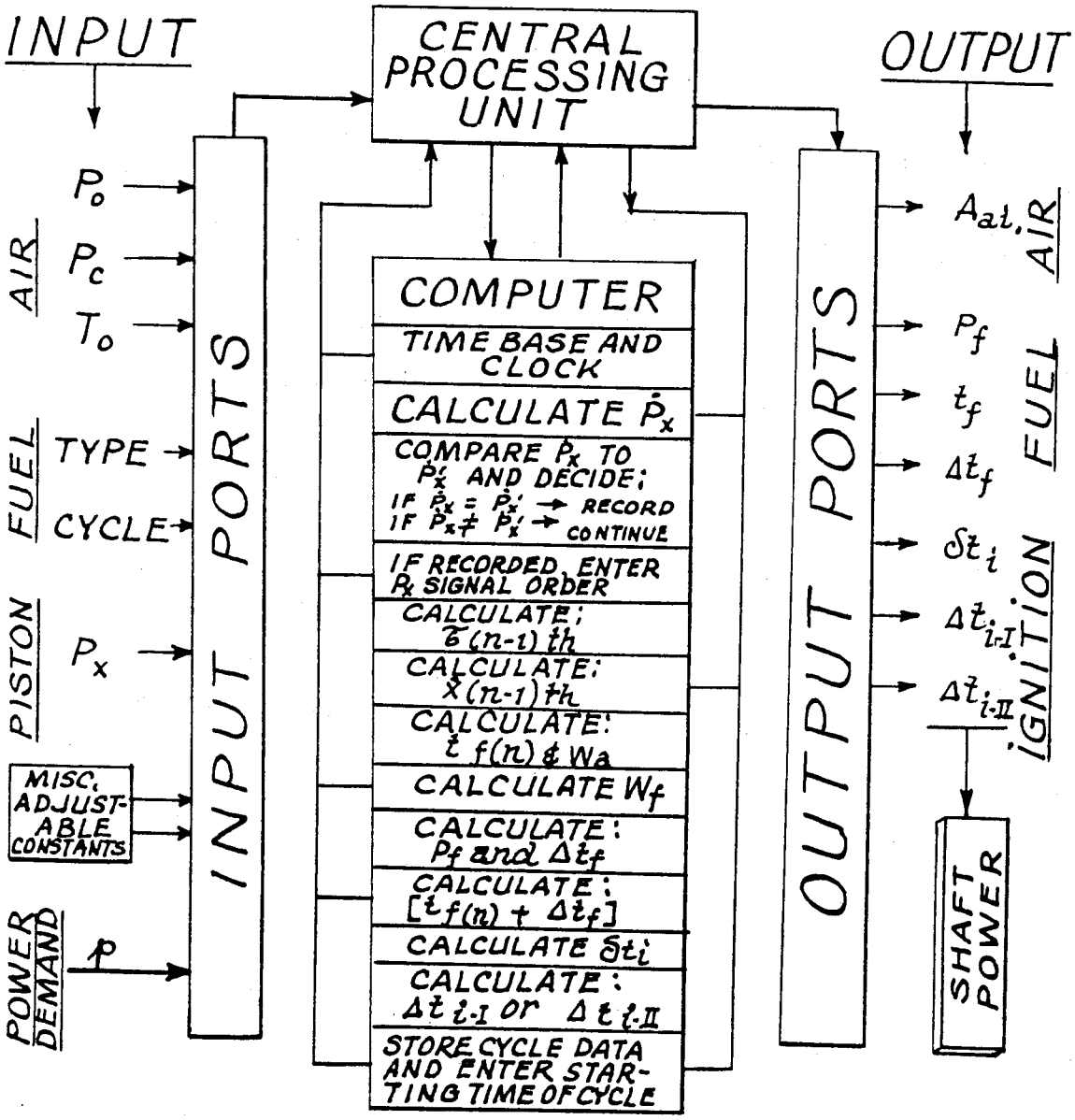

EXTERNAL COMBUSTION ENGINE WITH AIR-SUPPORTED FREE PISTON

CROSS-REFERENCE TO RELATED APPLICATIONS

This application is a continuation-in-part of my prior pending application Ser. No. 789,451 filed Oct. 21, 1985, which in turn was a continuation-in-part of my prior application Ser. No. 586,812 filed Mar. 6, 1984 and entitled EXTERNAL COMBUSTION ENGINE which resultedin U.S. Pat. No. 4,561,252 dated Dec. 31, 1985 and entitled FREE PISTON EXTERNAL COMBUSTION ENGINES.

BACKGROUND OF THE INVENTION

The present invention relates to an external combustion engine that combines the advantages of different types of piston and rotary engines, and even of gas turbines, into a single construction arranged in a manner such that the free piston never makes solid contact with the sleeve while operating.

Diesel and Otto Cycle engines produce undesirable vibrations and low frequency noise. Diesel engines require high compression ratios and are difficult to start. Piston engines require the transformation of linear motion into circular motion, which is costly in terms of space and weight, thus they are heavy and necessarily bulky. The Wankel rotary engine has not held its anticipated promises, its lubrication being one cause of problems. Gas turbines require high rotation speeds, are small and light, but generate high pitch noises, are unefficient and expensive to manufacture. They do not appear practical for propulsion application to automobiles.

Thus efforts are needed and continuously being made to develop new and different engine concepts; engines which would be smaller, lighter, less particular in terms of fuel type and quality, long lasting, easy to start, exempt of cooling and/or lubricating problems. Being easy to operate, less expensive to manufacture and more efficient, and capable to burn a wide range of more easily available and less expensive fuels are additional enviable characteristics.

In view of this background, it is an object of the present invention to provide a new and improved combustion engine which combines the most advantageous construction features of the three types of engines mentioned above embodied into an efficient power plant which will operate equally well with various types of fuel under severe conditions and during a longer lifetime.

It is another object of the present invention to provide a slower combustion process to enhance burning efficiency, thus minimizing air pollution and allowing the use of less volatile and expensive fuels, possibly of a non-fossil nature, as methanol.

It is another object of the present invention to provide an improved power plant that is of simpler construction and with fewer and simpler moving parts.

It is another object of the present invention to provide a new and improved type of engine that produces lower noise and vibration levels for comparable power.

It is another object of the present invention to provide a new and improved power plant that is characterized by design flexibility for accomplishing optimizing objectives such as space and weight saving for easy adaptation to a specific application.

It is another object of the present invention to provide a new and improved engine in which friction losses are minimized, thereby easing lubrication and cooling requirements.

It is another object of the present invention to provide a new and inproved power plant in which a heat exchanger combined with a storage tank for compressed air-and combusted gases may easily be installed between the combustion member and the power producing member.

It is another object of the present invention to provide a new and improved engine in which the mechanical segregation of the combustion member and of the power delivering member permits an optimum use of construction materials of a nature best suited for the specific component operation.

It is another object of the present invention to provide a new and improved power plant with enhanced overall reliability and in which maintenance and repair work is rendered easier and less complex and expensive.

It is another object of the present invention to provide a new and improved engine wherein the vibrations transmitted onto the engine mountings and the power shaft have lower levels and are of higher frequencies than is the case for conventional piston engines.

Finally it is still another object of the present invention to provide a new and improved engine in which the free reciprocating piston rides on pressurized compressed air cushions within its associated sleeve and the valving of the air and of the gas is automatic and requires no contact between piston and sleeve.

SUMMARY OF THE INVENTION

The above objects are retained by an external combustion engine utilizing an engine member including air compression means in communication with separate external combustion means. The resulting combustion gases pass from the combustion means into combusted gas expansion means which provides power for driving the compression means and useful shaft power. Accordingly,the present invention provides an engine in which the four principal functions: air compression, fuel combustion, heat exchange and gas expansion; are physically segregated. The combustion process is temporally independent from the operations of air compression and gas expansion. The power drive and the piston are not mechanically connected. Thus, the operating regimes of the combustion process and of power production are fully independent. The combustion has more time to proceed and is therefore more complete. No side loads are applied to the piston which is free to reciprocate frictionlessly.

DESCRIPTION OF THE DRAWINGS

FIG. 1 is a perspective view of the free piston showing partial sectional views of the valving air and gas channels.

FIG. 2 is a midsectional elevation of the free piston showing the central guiding shaft.

FIG. 3 is a graphic diagram showing the pressure variation between two restricting orifices in an air flow as a function of the orifice area ratio.

FIG. 4 is a schematic diagram of a detecting variable restricting orifice as formed by the piston and the sleeve.

FIG. 5 is a graphic diagram showing how the pressure between two restricting orifices varies as a function of time with the piston location and direction.

FIG. 6 is a view of the free piston developed outer cylindrical surface showing the relative positions of the piston channels and of the sleeve openings as the piston reciprocates.

FIG. 7 is a view of the free piston developed inner cylindrical surface showing the contours of the pressurized air cushions formed in cooperation with the central guiding shaft.

FIG. 8 is a diagrammatic representation of the two restricting orifices mounted in series and utilized to form the guiding air cushions between the central shaft and the piston.

FIG. 9 is a schematic diagram showing how the fixed restricting orifices and the variable restricting orifices are connected to control the air cushions supporting the free piston.

FIG. 10 is a transversal sectional view of the free piston taken along section line 10—10 of FIG. 2.

FIG. 11 is a longitudinal sectional view of the free piston taken along section line 11—11 of FIG. 10.

FIG. 12 is an enlarged transversal sectional view of the free piston and central shaft assembly showing details of the air cushion arrangement.

FIG. 13 is a partial midsectional elevation view of the free piston clamping system showing the piston in a clamped retaining position and taken along section line 13—13 of FIG. 14.

FIG. 14 is a partial transversal sectional view of the piston clamping system taken along section line 14—14 of FIG. 13.

FIG. 15 is a block diagram and system schematic combined showing the engine control system and engine interconnections.

FIG. 16 is a graphic diagram representing the shapes and comparative relative aspects of four basic combustion engine thermodynamic cycles.

FIG. 17 is a flow chart representing the operation of the data-processing function of the control system.

FIG. 18 is a schematic diagram representing an air cushion pad construction for controlling the tilting motion of the piston.

FIG. 19 is a partial cross-section of a sliding flexible seal for high pressure air containment.

DESCRIPTION OF THE INVENTION

Referring to FIGS. 1 and 2 of the drawings, a free piston 20 is shown installed for reciprocating motion within a sleeve 50 having end closures 52 and 54 supporting a centrally located hollow shaft assembly 100. Piston 20 is free to slide on the external surface of shaft 101 from one end closure to the other, forming combustion chambers 30 and 40 at the end of each stroke. Central bore 21 extending through piston 20 accommodates shaft 101. The cylindrical part 51 of sleeve 50 is equipped with stub assemblies (53 of FIG. 10) having a stub protruding inwardly for fitting inside cooperating grooves cut on the outer cylindrical surface of piston 20. The centerlines of such grooves are represented by the dash lines 23, 25 and 27 of FIG. 1.

A hole 55 located along the axis of a stub guided by a groove forms a variable orifice 56 in cooperation with the surface of a raised bump 57 located on the bottom surface 58 of its groove, as shown schematically in FIG. 4. The discharge area 56 formed by a cylindrical portion extension of hole 55 between the top surface of bump 57 and the end of stub 53 is the second of a series of two orifices shown diagrammatically in FIG. 8. Air at pressure $P_1$ is fed into tube 59 and passes through a fixed size orifice 60 before it is allowed to proceed through variable orifice 56 to discharge at a pressure $P_2$. The air pressure $P_i$ between the two orifices is temporally monitored. If $P_1$ and $P_2$ are assumed constant, $P_i$ plotted as a function of the orifice area ratio varies as shown in the graph of FIG. 3. As a stub passes by the bump, the area of variable orifice 56 varies considerably as is represented by the graphs FIG. 5 where pressure $P_i$ variations are shown as a function of time. The sides of bump 57 are not symmetrical so that the orifice size varies more rapidly on the abrupt side, for any given velocity of the piston.

Because pressures $P_1$, $P_2$, the piston velocity and the distances h or h' must be allowed to vary from time to time, the curve $P_i$ as a function of time also varies, between the extremes A and B of FIG. 5. However, the two branches of the curve maintain their relative appearance regarding the relative rates of rise and fall of pressure $P_i$. As is discussed in the next section, these rates are detected so as to generate signals which indicate where the piston is located and in which direction it travels.

In addition to the grooves mentioned above, piston 20 exhibits two pairs of similar channels and one set of openings into and out of one channel of one pair. The function and role of the channels and openings are extensively described and discussed in my U.S. Pat. Nos. 4,399,654 and 4,561,252. They are used for connecting the combustion chambers 30 and 40 to the compressed air inlets ports 31 and 41 in sleeve 50 , and to the combusted gas oulet ports 34 and 44 in the sleeve. Inlet ports 37 and 47 in the piston, open channels 35 and 45 on the piston are caused to register with their corresponding port counterparts 31 and 41, and 34 and 44 in the sleeve respectively, as the piston moves concurrently longitudinally and rotationally as it reciprocates inside sleeve 50, as is described in more detail later on. The wall surface of specially configured central bore 21 does not communicate with either of the above mentioned channels or ports.

Channels 35 and 45 for ducting the combusted gas out of the combustion chambers are formed by longitudinal grooves cut into the piston wall cooperating with sleeve wall 51 inner surface. The ends 36 and 46 of these two channels always remain open. On the other hand, channels 32 and 42 ducting the compressed air into the combustion chambers must be embedded in the piston wall for reasons later explained. The ends 33 and 43 of these two channels also remain open continuously. For both compressed air and combusted gas valving systems, the equivalent of opening and closing of valves occurs when ports 31 and 41 come into or out of registration with ports 37 and 47 respectively for the air, and when ports 34 and 44 come into or out of registration with channels 35 and 45 respectively for the combusted gas.

The drawing of FIG. 6 is a planar view of the developed cylindrical surfaces of piston 20 and sleeve 50 superimposed showing the piston in the mid-position it occupies in FIG. 2. The air inlet ports and channels, the combusted gas outlet ports and channels, and their ends opening into the combustion chambers 30 and 40 are clearly identified in FIG. 6. The three stubs 53, (53) and (53') are shown located on the left side of their respective guiding grooves 23, 25 and 27; in which case reference line L is in a position indicated by L' and reference line R is in position R'. When piston 20 rota during two consecutive half-strokes stubs then occupying positions 53', (53)' and (53')'), line L' to position L and line R' comes to position R. Any po the external cylindrical surface of the piston has moved a distance λ to the right. Another two half-stroke rotation of the piston bring the stubs at their starting positions. During one full travel of either stub along its guiding groove, the piston travels two strokes, which corresponds to two high pressure combusted gas production cycles, one for each combustion chamber. The various meaningful piston positions are indicated and are discussed in the next section. The external surface of the piston never comes into contact with the sleeve wall internal surface during such piston motion, except for the guiding contacts continuously made by the stubs with their associated groove walls, by means now to be described.

Referring to FIG. 2, piston 20 is represented riding on a centrally located hollow shaft 100 that has an external cylindrical surface 101. Piston inner bore 21 is shaped to provide cavities at both ends for accommodating the protrusions 102 and 104 located at the ends of shaft 100. These cylindrically shaped protrusions house piston clamping and retaining systems later described and also serve as shock bumpers and pneumatic bouncers. The inner surface of bore 21 mainly consists of two lands 62 and 64 defining a cylindrical space 63 wrapped around shaft surface 101. The diameters of lands 62 and 64 are dimensioned to provide radial clearances with surface 101 which are smaller than the radial clearance between piston 20 outer diameter and sleeve 50 inner diameter. This is enough to prevent piston 20 and sleeve 50 from ever touching, but it is also the intention here to prevent piston 20 from ever making solid contact with shaft 100. To that effect, air cushions are formed in space 63 in a manner illustrated in FIG. 7, where four such air cushions are shown.

The inner surface of bore 21 is represented developed flat. Lands 62 and 64 forms two narrow bands located on each side of a plurality of elongated areas such as 65 and 66. Areas 65 are enclosed within narrow lands such as 67 which extend inwardly the same amount as do lands 62 and 64. Such is also the case for all of the enclosed spaces corresponding to areas 65. Between lands 62 and 64, and between lands such as 67 and 68 of contiguous enclosed spaces (areas) 65, areas (or spaces) 66 are also formed, but all connected by grooves such as 69 and 71. Space 63 of FIG. 2 thus comprises four separated spaces 65 and one series of spaces 66 all interconnected, but contained between lands 62 and 64. Each space 65 is supplied with high pressure air by means of one hole 70 equipped with a restricting orifice 72. Each space 66 is vented to low pressure air by means of holes such as 73. The air may escape spaces 65 only through the clearance provided between surface 101 and narrow lands 67. Such air can then be collected by spaces 66 and grooves 69 and 71 for venting out through holes 73. The escaped air is channelled out inside the left half 75 of hollow shaft 100 and the high pressure air is brought inside the right half 74 of the shaft. These two halves of the internal volume of shaft 100 are separated by partition wall 90. Fixed restricting orifices 72 and the variable size restricting orifices formed by land 67 clearances are mounted in series and the diagram of FIG. 8 may again be used to explain the working of any of the four air cushions that isolate piston 20 from shaft 100, which is done in the next section.

The overall pneumatic connections between spaces 65, shaft 100, land 67 clearances and fixed size restricting orifices 72 may be represented diagrammatically as shown in FIG. 9 where a set of four fixed restricting orifices are each associated with one variable size restricting orifice mounted in series. All fixed size orifices are supplied by the same source of high pressure air at $P_1$ pressure and all variable size orifices discharge this air at the same pressure $P_2$. The air pressure $P_i$ betweeen the fixed and the variable orifices varies as shown in FIG. 3 with the variable orifice discharge area. Because the same surface 101 is identically associated with all variable size orifices and because two diametrically opposed orifices in each orifice pair are affected to the same degree but in opposite manner, the sum total of the variable orifice areas is constant and pressure $P_1$ is almost unaffected by any radial movement of bore 21 with respect to shaft 100, the operating segments a-b of FIG. 3 curve being almost straight. Pressure $P_i$ exerted on areas such as 65 of FIG. 7, but diametrically opposed, average to a quasi constant value, but the difference between them generates a force on shaft 100 and on piston 20 of direction opposite to that which caused the pressure variation The forces thus developed by the air cushions cooperate to maintain the distances between surface 101 and lands 67, 62 and 64 within narrow limits which are always kept smaller than the radial clearance existing between them.

The piston sections shown in FIGS. 10, 11 and 12 represent the configurations of bore 21 and of the air and gas ducting between sleeve 50 and piston 20 in more details. In addition to the already identified items, FIG. 10 drawing shows how compressed air is brought in by duct 80 into manifold 81 servicing ports 31 and 41, and how combusted gas is channelled out through collection manifold 84 and duct 83. Each stub assembly 53 is supplied with high pressure air through line 86 from a common source (not shown) delivering air at pressure $P_1$, the air flows through one restricting orifice 60 common to all stubs. The variable orifice 56 of FIG. 4 then represents the sum of all three variable orifices formed by the ends of the three stubs and only an average pressure $P_i$ is detected by pressure sensor 87 which generates an indicative signal 88 representative of the piston location and direction for further processing. The internal hollow space 85 between bore 21 wall 20' and the outer piston wall structure is intended to lighten the piston. The rotational amplitude α the piston corresponds to dimension λ of FIG. 1 which represents the length of the small axis of t quasi elliptical track centerlines earlier identified. This amount α of angular displacement of the piston is also such that, such piston oscillation, holes 70 and 73 never leave the confines of their assigned spaces 65 and 66, respectively, and do not ever reach lands 67 and/or 68 of FIG. 7. For this reason, the most practical and ideal number of air cushions is four in the construction of the valveless free piston of the present invention, if three guiding grooves are used, as illustrated.

In order to minimize the piston length, holes 70 and 73 must be located in the same transversal plane, as shown in FIG. 11. Wall 90 separates spaces 74 and 75 inside shaft 100 in which the air pressures are $P_1$ and $P_2$ respectively and very different naturally. Separation wall 90 is thus shaped as illustrated by sectional views of FIGS. 11 and 12, and by the phantom line 90 of FIG. 7. As an indication of the paths followed by the centers of holes 70 and 73 during the piston motion, phantom lines 91 and 92 are shown in FIG. 7 representing such paths, where dimension l thus corresponds to dimension λ of FIG. 1 and angle α of FIG. 10. Dimensions S (piston of FIGS. 1, 6 and 7 are naturally, and must necessarily be, the same.

FIGS. 2, 11, 13 and 14 present drawings of a system constructed to perform two functions which are essential to the operation of the free piston during both engine starting and working operations, as is discussed in next section. Protrusions 102 and 104 of FIG. 2 form bodies of revolution which are centered and dimensioned to fit snugly into spaces outlined by contours 102' and 104' shown in FIG. 11, so that, at the end of each piston stroke, a volume of combusted gas becomes trapped and further compressed. The compression of this residual amount of gas provides the force needed to stop the piston at the end of its stroke and to push the piston back outwardly (bouncing). This effect considerably decreases the loads applied on the guiding stubs by such obligatory piston velocity reversal. Protrusions 102 and 104 also house and guide the mechanisms needed for holding the piston in place during the starting cycle of the engine, and the ducts that channel the high pressure air required by the air cushions. Hooks 105 articulated in the wall of protrusion 102 are constructed to swing in and out of conical tip 106 structure which supports shaft 100. Pushers 107 and 109, part of hook 105 structures, ride on the external contoured surface of plunger 108. The plunger contour and the hook structure are both configured so as to cause hook 105 to swing freely but within guiding constraints that always insure an exact and tight positioning of the hook tips 110. Plunger 109 is actuated by piston 111 inside associated cylinder 112 which is vented at both ends to pressurized air ducts 113 and 114, wherein piston 111 actuates plunger 109 into only either a fully retracted or protracted position, as the case may warrant. Tips 110 of the hooks may thus either fit in grooves 115, in the protracted position, or remain lodged snugly in slots 116 cut in tip 106, in the retracted position. In the latter case, the end surface of hook tip 110 is flush with the conical surfaces of protrusion tips 106, and very little clearance space exists between the snugly matching slot 116 and tip 105 surfaces. Hook articulation 117 is constructed to allow some accommodation in the hook positioning, except in a radial direction.

Between the hooks, ducts 118 channel high pressure air into space 74 inside hollow shaft 100 (or out of space 75) from supply (or collecting) manifold(s) 119, (119') protrusion 102 being used for such air supply and protrusion 104 being used for returning the lower pressure air coming from air cushions 63. Grooves 115 need not continuously extend around bore 102', but only to an extent represented by angle β of FIG. 14, accommodating the rotational motion of the piston during the end of its stroke. Such a limitation of the length of grooves 115 considerably strengthens the structure of catching rim 120 which has an inner diameter a little larger than the inner diameter of cavity 102'.

The operation of the engine of the present invention is diagrammatically represented in the schematic shown in FIG. 15. A sliding-vane engine 150 comprising a rotor 151 housing a plurality of vanes 152 rotates inside a fixed housing 153. The rotor and the housing are shaped so as to form a compression chamber 154 and an expansion chamber 155 when the vanes move in the direction shown by arrow f. Atmospheric air is introduced through inlet duct 156, compressed in chamber 154 and then exhausted by means of duct 157. The combusted gases are introduced in expansion chamber 155 through duct 158, expand producing power and exhaust to the atmosphere by means of exhaust pipe 159. The excess of power generated by the gas expansion over the power needed to compress the air is delivered to power shaft 160 which drives a plurality of mechanisms including a fuel pump 161 and an air compressor 162.

Fuel from the pump is metered by fuel control 163 which feeds fuel injectors 164 and 165 mounted on sleeve 50 end closures. A signal line 166 connects control 163 to a central processing unit which determines the amount of fuel to be injected during any cycle of the free piston. Spark plugs 167 and 168 monitored by ignition control 169, which is also connected to the central processing unit (CPU), are also mounted on the end closures of sleeve 50. Both compressed air and combusted gas are temporarily stored in storage tank 170 which also acts as a heat exchanger where hot combusted gases heat cooler compressed air before it is introduced in combustion member 180. Inside tank 170, both the pressure $P_a$ and the temperature $T_a$ of the heated compressed air are measured by sensors 171 and 172 respectively. This data is fed into the CPU by means of input ports which receive the signals generated by those sensors.

Some compressed air from the storage tank, further compressed by compressor 162, is pressure regulated by regulator 173 before it is supplied to manifold 119 and restricting orifice 60 supplying guiding stubs 53 with high pressure air. Manifold 81 for compressed air and manifold 84 for combusted gas service the inlet and outlet ports of sleeve 50. Pressure detector 87 monitors air pressure $P_i$ between stubs 53 and restricting orifice 60 and a signal representative of $P_i$ is generated and sent to an input port for processing by the CPU. For the sake of convenience, stub 53 is shown inside manifold 84, whereas the exact locations of the stubs are as shown in FIG. 10.

In addition, the engine equipment includes an air intake valve 175 connected to the output ports by signal line 176, a check valve 177 mounted on the storage tank at the connection with the gas exhaust duct from the combustion member and an optional check valve 178 mounted between air intake valve 175 and manifold 81. Various signal lines are omitted in almost their entirety but are shown at their end points where they make connection. Corresponding letters indicate the origins and endings of such lines so that any reader familiar with the art may complete such connections. It is understood that the lowest level of air pressure $P_2$ is always only slightly higher than the compressed air pressure. For that reason, the air coming from the air cushions through manifold 119' is shown being returned to line 179 which connects storage tank 170 to compressor 162 and air intake valve 175.

Referring to the graphs of FIG. 16, three basic thermodynamic engine cycles are presented and identified by points on curves representing the variations of pressure as a function of volume (P-V Diagram). They are: (1) the OTTO Cycle (0-1-2-4-0), corresponding to the gasoline internal combustion engine (IC); (2) the DIESEL Cycle (0-1-32-4-0) also an IC engine; and (3) the BRAYTON Cycle applicable to gas turbines (0-1-3-5-0). Superimposed on the same diagrams is the outline shown in phantom lines of a typical cycle which may best represent the thermodynamic cycle describing the operation of the engine of the present invention. It follows closed loop 0-1-6-4-7-0. An optional check valve 178 is shown in FIG. 15 located between the air intake valve 175 and the compressed air admission manifold 81. The term "optional" means that it may or may not be used.

The present valveless external combustion engine (EC engine) may operate similarly to a Diesel engine or to a gasoline IC engine, depending upon the type and timing of the combustion which takes place in the two combustion chambers. Obviously, if an explosion-type of combustion occurs, the peak pressure $P_m$ of the OTTO Cycle cannot be allowed to happen before the compressed air inlet valve is closed. Furthermore, the condition of excess pressure above $P_c$ in the combusted gas exists until said gas expands to point 3 (V'). However, if a check valve is installed at point C of FIG. 10 for instance, the gas excess pressure above the compressed air pressure will cause the check valve to close and prevent combusted gas from flowing backward to air intake valve 175. The excess pressure above mentioned will subside as the combusted gas expands while the free piston moves away from the combustion chamber in which the explosion just took place.

However, if the fuel combustion is initiated as soon as said fuel starts entering the combustion chamber volume, both rates of compressed air introduction and fuel injection may be programmed so as to maintain the combusted gas pressure below the compressed air pressure, assumed here to be $P_c$ theoretically. No explosion takes place and the fue as it would in the case of a Diesel IC engine. Check valve 178 is thus not needed. Readers familiar with the art will understand why and how the fuel nature, the fuel injection mode and the fuel ignition mode and timing must then differ. The explosion mode of operation is referred to hereinafter as DAVID-I (check valve needed) and the fuel burning mode of operation is referred to as DAVID-II (no check valve).

At this point it should be mentioned, as is discussed in my U.S. Pat. No. 4,399,654, that the free piston of a dynamic combustion its own built-in valving means is never used to compress air, but only to form and segragate two separate combustion chambers and to use some of the just-formed combusted gas energy in one chamber for expelling the combusted gas previously formed in the other chamber. The operation of the combustion member includes neither air compression nor direct gas expansion functions. The free piston combustion member function is strictly to burn fuel in compressed air and to deliver combusted gas at an average pressure approximately equal to that of the compressed air. Its role may best be compared to that of the combustion chamber(s) of a gas turbine. Also, because the mechanical means used for compressing atmospheric air and the mechanical means used for expanding the combusted gas, although they may be the same, function separately from one another and continuously use their own non-interchangeable spatial mechanical confines, the volumes needed for air compression and gas expansion may differ appreciably. This aspect of the EC engine operation makes it resemble even more closely that of a gas turbine.

For these reasons, the BRAYTON Cycle of FIG. 16 may best be used as comparison basis to depict the EC engine types of operation. A DAVID-I EC engine which requires the use of a compressed air check valve, and in which the gas expansion volume is larger than the air compression volume, operates approximately according to cycle 0-1-6-3-4-7-0. For all comparisons between cycles, the compression ratios $V_i/V_c$ of all engines are assumed to be equal. Portion 1-6-3-1 of the cycle above either a DIESEL Cycle or a BRAYTON Cycle represents a cycle efficiency gain over either cycle. The area 1-2-3-6-1 represents a cycle efficiency loss as compared to an OTTO Cycle. Portion 0-4-7-0 of DAVID-I Cycle left of both OTTO and DIESEL Cycles represents a cycle efficiency gain over either cycles. However, cycle area 7-4-5-7 represents a cycle efficiency loss compared to a BRAYTON Cycle. In reality, cycle areas 1-2-3-6-1 and especially 7-4-5-7 are of the order of magnitude of cycle area losses imposed for practical reasons on all engine theoretical cycles. A DAVID-II EC engine operates according to cycle 0-1-3-4-7-0, representing a cycle efficiency gain corresponding to cycle area 0-4-7-0 and a cycle efficiency loss corresponding to cycle area 1-2-3-1, as compared to a DIESEL Cycle.

Other important operational differences between the present EC engine and an OTTO Cycle IC engine, and also a DIESEL engine or a gas turbine, which indirectly affect cycle efficiencies are due to the practical aspect of power level adjustment and of its consequences. Usually, power is adjusted in an OTTO IC engine by throttling the air admission to the compression, and by adjusting the amount of fuel in a gas turbine or a DIESEL engine which results in the engine adjusting the amount of air admitted, itself by means of engine rotational speed adjustments. In all of these cases, the rotational speed of the engine is directly related temporally to the combustion process, which disadvantageously affects the theoretical cycle data. In the case of the present EC engine, the combustion process remains unaltered, regardless of the rotational speed of the engine "motor" ("motor" referring to the rotating part of an EC engine). The frequency at which the combustion member operates (number of cycles per second, cps, of the free piston) may freely and widely vary while the motor speed remains constant, especially during transient operating conditions. This temporal decoupling between the operating regimes of the motor and of the combustion member results in power level adjustments having lesser detrimental effects on the engine cycle efficiency. In other words, operating off its design point is less costly, efficiency-wise, for the present EC engine than it is in the case of IC engines or gas turbines. EC engines of the present type also requires a control system of a more complex nature as a consequence thereof. FIG. 17 illustrates the operation of such control system by means of a combination of block diagram and flow chart which indicates the nature of the engine parameters being sensed and of the control operations being automatically monitored, once the engine operator has set the power level demanded. A more exact and complete discussion of the operation of such minimal control system is given in the next section. Suffices it to say presently that the engine power is determined by the concurrent adjusments of both the amount of air introduced and the amount of fuel admitted in the combustion member during each and every cycle of the free piston, a cycle corresponding to any one-way stroke of the piston. The working means to which the power is delivered by the motor is neither directly connected to the combustion member nor affects the combustion process.

DISCUSSION AND OPERATION

The general operation of an external combustion (EC) engine shch as that which is described in the preceding section is extensively discussed in my U.S. Pat. Nos. 4,399,654 and 4,561,252. Thus the following discussion is limited to the combustion member (also referred to as dynamic combustion system or free-piston combustor) described herein and which operates without valves and with no friction, in conjunction with a vane motor. The operation of various constructions of typical vane motors is also described and discussed in U.S. Pat. No. 4,399,654. However, it is assumed that the vane motor used with t dynamic combustor of the present invention is constructed for operation without lubrication, whereby all sliding surfaces are isolated by air cushions which prevents solid contact between two cooperating sliding surfaces. Thus, the high pressure air supply needed for the air pads is shared by both the free-piston combustor and the vane motor which, when coupled together, form an external combustion vane engine having a pulsating combustion system. This section is subdivided according to classes of main subject matter.

Automatic Valving

The automatic valving for the introduction of compressed air and exhausting of combusted gas in and out of the combustion member is performed by the piston outer cylindrical surface in cooperation with the inner cylindrical surface of the sleeve in which the piston reciprocates. The registering of ports located on both cooperating surfaces results in either closing or opening passages between ducting channels located in both piston and sleeve. This operation is discussed in detail in U.S. Pat. No. 4,399,654. It is illustrated in FIG. 6 which shows these two cylindrical surfaces developed and superimposed, where contour 36 represents the piston and phantom lines 36' to the sleeve. Combustion chambers 30 and 40 extend surface contour.

As earlier mentioned, the piston is forced to move sideways a distance λ when it travels stroke S. Line L of contour 36 moves between positions L and L', and Line R' of contour 36 moves between positions R' and R during the process. For each double stroke S (full forth motion of the piston), the sleeve ports shown cross-hatched—34 and 44 for the combusted gas, and 31 and 41 for the compressed air—follow the nearly elliptical pattern imposed on the piston s relatively to the sleeve surface. The loci of the most outwardly oriented corners of these ports are represented by thin phantom lines E3 and E4 for the exhaust ports, and A3 and A4 for the air introduction ports. The digits 3 and 4 serve to indicate the combustion chambers—30 or 40—which the ports service. The areas inside these locus loops enclose a portion or all of the areas of the ports located on the piston surface during part of the piston stroke. It is thus easy to determine when total, partial or no registering of two cooperating ports occurs. It is assumed that total or partial registering corresponds to an open valve and that no registering corresponds to a closed valve. Such action provides the automatic and fixed timing of the valving of compressed air and combusted gas which is described and discussed in detail in U.S. Pat. No. 4,399,654. Because the piston and sleeve sliding surfaces cannot physically coincide and some clearance is always needed, this type of valving can never provide a tight seal, air and gas leaks must be accepted whenever the "valve" is "supposedly" closed.

Such leaks are negligible in terms of energy losses. However they could be disastrous in the case of a gasoline piston engine in which such leaks of hot freshly combusted gas usually ruin a valve-and-seat assembly very quickly. As is discussed later, the operating combusted gas temperatures of the EC engine are rather of the order of those characterizing Diesel engines. Therefore, it is believed that the jetting action of the combusted gas in the present application will not cause those damages typical of imperfectly seating valves in gasoline piston engines. In addition, two factors play a vital role in minimizing and/or eliminating the effects of such leaks: (1) the use of hard refractory materials (ceramics) to construct the edges of the combusted gas exhaust ports, and (2) the presence of cooler pressurized air between the two which prevents combusted gas from flowing past the exhaust port areas. These two factors are discussed further on in this section.

Two other functions, dependent upon the piston location and motion direction, are referred to in FIG. 6 and are identified by narrow solid line bands F and F', G and G', and H and H'. They represent the range of piston positions during which fuel is injected and fuel combustion is initiated. The small squares shown on the quasi ellipses indicative of the piston motion represent the piston center plane positions at which opening and/or closing of the valving system during a piston double stroke—two S's. They are referred to as ao1, ao2, ao3, acl, ac2 and ac3 on ellipses ①, ② and ③ respectively for one side of the ellipse, for compressed air valving opening (o) and closing (c); and as go1, go2, go3, gc1, gc2 and gc3 for combusted gas valving, with the same appellation conventions. The other side of the ellipses has call outs with an ' indication. These square positions indicate the piston locations at which the corner edges of two cooperating ports pass each other. The small circles located at the ends of the ellipse long axes indicate the limits of the piston strokes - or axial velocity reversal points.

As geometrically obvious, the symmetry of locations of these points is with respect to the ellipse centers. This means that the piston must travel in one direction only, as shown by the arrows starting at the circles representing the guiding stubs. The result is that both the position and direction of motion of the piston must be detected so as to insure the proper relative positioning of bands F, G and H with the set automatic valving of the compressed air and of the combusted gas.

Piston Location and Direction Detection

Because the timing of the valving is fixed and set by the piston location and because the fuel injection and combustion must necessarily be temporally function of the valving timing, it is suitable to tie the fuel injection and combustion initiations to the piston location also. Because the piston must be guided by a structural element that extends from the sleeve to the piston, it is logical and simple to utilize that element for detecting the passing by of the piston, and the direction in which it is travelling. Because the piston is supported by air cushions and laterally directed side forces are to be avoided, three quasi elliptical track grooves are used and arranged so as to be distributed around the piston circumference as evenly as possible. Each groove receives a stub 53 and it will be assumed that each one of all three stubs makes contact with its respective groove.

So as to prevent physical contact between the piston and the means for sensing the piston position, high pressure air is used. The passage of an obstruction in the air flow circuit disturbs such air flow. The disturbance is sensed and a corresponding signal is generated. Such systems are commonly used in servo-mechanisms in which the fluid medium is a gas. Two basic approaches are available to that effect to the designer: (1) interrupt the fluid flow, and (2) restrict that flow. The first approach embodied in the ASKANIA Valve concept is based on sensing the flow emerging from a nozzle in term of recovery or dynamic pressure in the emerging jet. Interrupting the jet flow with a flap affects the dynamic pressure detected. The second approach is embodied in a restricting orifice having a variable discharge area by means of an obstacle placed in the proximity of the discharge venting. This "variable" size orifice is mounted in series with another fixed size orifice (see FIG. 8). The variation of the pressure between the two orifices is sensed and indicates the presence of the obstacle to be detected. Obviously, in the present case, the obstacle affecting the emerging jet must be one guiding stub, the means for forming the jet being provided in its groove structure.

It is also obvious that the air pressure-variation sensing device should be located on the sleeve and not on the piston. It seems also evident that machining grooves on the outer surface of the piston is more practical than doing it on the inner surface of the sleeve. The stubs should then be mounted on the sleeve. For these reasons, the variable size orifice approach appears better suited to the present construction. It is shown in the drawings of FIGS. 4 and 10. The stubs are hollow and contain the fixed size restricting orifice 0 (FIG. 4). Bumps B located on the bottom 58 of the groove raising above level L cooperate with the end face F of the stub to form the variable size orifice of minimum area $\pi dxh$ whenever a stub passes over a bump. The slopes of the bump from level L are unequal: steeper on one side than on the other side.

As the piston moves in the direction of arrow f, one can see why and how the pressure in space 55 that is sensed varies at a different rate when the stub encounters a ramp, depending upon which ramp is first encountered. The rate of change of $P_i$ as a function of time, for a given constant velocity of the piston, appears asymmetrical as depicted in the curves of FIG. 5. The influences of two variable factors must be eliminated. They are caused by the fact that the piston never remains perfectly centered on the same same axis because some lateral play must be allowed. This imposes arbitrary variations of the values of h' and h, hence of the absolute value of $P_i$. Also, the supply pressure of the high pressure air may not be constant. For practical and safety reasons, it is preferable to have each stub equipped in a similar fashion, all three volumes 55 being interconnected. The combination of the extreme values of these factors results in a set of two limit curves, A and B, representing the maximum and minimum values that $P_i$ may reach as a function of time. m and M represent the minimum and maximum peak values of $P_i$ between the supply pressure $P_1$ and the venting pressure $P_2$. rM and rm correspond to the pressure rises of these curves. fM and fm correspond to their pressure falls.

Ducts Q of FIG. 4 are all connected to one pressure sensor. The average pressure $P_i'$ all three pressures $P_i$ is measured and a corresponding signal is generated and sent to the central processing unit (CPU) where the value $dP_i'/dt$ at mid-point between the two extreme values of $P_i'$ is calculated. The piston, the sleeve, the grooves, the stubs and their positioning, and the piston-sleeve clearances are all such that the maximum error caused in the worst cumulative case of tolerances on and misaligning of these parts can only result in an alteration of the maximum slope $dP_i/dt$ of lesser value than the difference between the absolute values of these slopes between the rising and falling sides of the curves. The initiation of the pressure rise indicates the piston location. The comparison of the absolute values of the two slopes indicate the direction in which the piston is travelling. If the high value slope is sensed first, regardless of its absolute value, the piston is allowed to proceed. If the low value slope is sensed first, the piston should be stopped. This is done at the end of that stroke, by arresting and clamping the piston. This condition can occur only when the engine is being started. This is discussed further, later on.

Because only a rapid rise in pressure and the relative comparison between two absolute values of fast succeeding pressure variations are used in this piston detection approach, the probability of failure due to mechanical mishap is negligible. For instance, if one or even two orifices 0 become clogged, changes in values of $P_i'$ will still happen. A problem could be created only if some matter became packed solid at the base D of the rising bump ramp, which would affect the slopes of curves rm and/or rM and cause some engine starting problems. For that reason, it is imperative that the high pressure air be filtered. The building up of foreign matter at this location (D) is not likely to happen suddenly. At a certain point during this build up, the gradual slope change becomes noticeable and can be detected by the CPU, if accordingly programmed, so that an alert signal may be generated and sent to an emergency-type light to warn the engine operator.

Free Piston Support and Guidance

Supporting and guiding the piston are two related functions. They interact both physically and functionally. Both could be performed at the interface between piston and sleeve. However, this would seriously affect the combustion member configuration and construction, as it would either elongate the piston or require a larger piston diameter. Neither choice is deemed advisable for various reasons. In the prefered embodiment of the present invention, the means for performing each function is physically separated from the other. Also, as is shown later, the provisions for clamping the piston are best located away from the piston/sleeve sliding interface, and close to the means used for keeping the piston centered. For these reasons, a central hollow shaft is used for guiding the piston in its axial and rotational movements. However, the imposition of the rotational motion as a result of the axial motion is effected at the piston/sleeve interface. This results in the piston and sleeve constructions illustrated in FIGS. 1, 2, 6, 7, 10 and 11. The two functions—support and guidance—must be performed in a manner such that their means are both compatible and non-interfering, complementary and non-redundant.

The lateral or radial support and axial centering of the piston is accomplished by the central shaft with the two provisions that the piston must never make contact with an adjacent surface while it is reciprocatingly sliding and that concurrently its radial or lateral displacements must remain very small, friction being meanwhile totally avoided. This is achieved by means of air cushion pads located between the shaft outer cylindrical surface and the inner cylindrical contour of the piston matching central cavity. The walls of this cavity are shaped to form four elongate thin spaces wrapped around the shaft outer surface. Narrow lands help confine these four spaces so as to almost seal them, especially when the lands contact the shaft. Four axially oriented lands divide the total annular volume occupied by these spaces into four equal quadrants. The narrow gaps between the lands of each quadrant and the shaft external surface each constitutes a variable size restricting orifice. A fixed size restricting orifice is placed in series with its cooperating variable size orifice so that the developed overall system looks diagrammatically like the schematic shown in FIG. 9. Duct 74 brings high pressure air to fixed size restricting orifices such as 72. Each orifice vents into an air cushion pad such as 66. The lands around each pad volume defined by line 1 form in cooperation with the shaft surface defined by line 1' a variable size restricting orifice having an effective discharge area equal to the product of the land length by the distance between 1 and 1'. In the real undeveloped configuration, 1 would form a circle around the circle formed by line 1' and of slightly smaller diameter, lines a and a' coinciding then.

As the outer mobile circle "1" becomes off-centered with respect to fixed circle "1'", the mean radial separation distance $\lambda^*$ between them varies. Assuming that spaces ① and ③, and ② and ④ are respectively diametrically opposed, and that this radial displacement tends to close the orifice of space ①, to open up the orifice of space ③, leaving the others unchanged, the gap of the first orifice increases by $\lambda'$, whereas the gap width of the third orifice decreases by the same amount $-\lambda\lambda'$. Everything else remaining the same, the pressure in space ① decreases as the discussion of FIGS. 3 and 8 revealed. Concurrently, the pressure in space ③ increases for the same reason, whereas the pressures in spaces ② and ④ do not vary. The net result is a force exerted against the piston cavity walls which opposes the displacement that caused the variations $\lambda'$ and $-\lambda'$.

The functional and operational description above is that of an air cushion bearing in which the shaft do not rotate but is held fixed while the journal is free to slide along it and/or rotate about it. The piston radial position feedback is insured although no contact between 1 and 1' ever took place. The reader familiar with the art will thus understand how and why the piston is thus enabled to slide and oscillate on air cushions while its radial position is forced to remain within $\pm\lambda_M$ if $\lambda_M$ is the maximum lateral radial displacement that the side forces imposed on the piston are ever allowed to create. This is of course true for any radial direction in which such forces may be applied.

Practically, the amount of play between the shaft and the piston air pad lands can be kept within a few to several thousandths of an inch and lateral radial displacements of the piston can be limited to 0.009 to 0.010 inch. This amount is infinitesimal compared to the length of the air cushions. The piston is therefore also prevented from tilting any meaningful amount. However, if only piston tilting loads are applied, the reasoning above does not hold. A torque exerted about a radially oriented axis on the piston results in closing the land gaps at one end of the air pad, while opening the land gaps at the other end by the same amount. This action results in no variation of the total land gap discharge area and no change in the air pressure inside the air cushion. The same applies to the opposite air pad. Lands then make contact with the shaft outer surface and neither restoring forces nor restoring torques are generated. Such possibility is unacceptable. How could such torques be ever created?

Although the piston is not subjected to mechanically created side loads, unbalanced pressure forces are applied laterally on the piston cylindrical outer contour. These are exerted on the bottom surface of open channels 35 and 45 (FIG. 6), on a surface equivalent to the areas of ports 37 and 47, longitudinally and off-axis on the equivalent of the discharge area of openings 33 and 43, ignoring other miscellaneous variable partially balanced loads less easy to identified. The nature of the pressure-caused loads exerted on the compressed air and combusted gas channels within the piston is such that they: (1) vary synchronously with the piston motions, (2) are applied repeatedly in terms of direction, magnitude and frequency, and (3) are not applied simultaneously but in a fixed sequence. Fortunately, they are of small magnitude compared to the presssure forces applied axially on the piston. However, the piston is free floating and resonant conditions could easily be established which could cause the piston to tilt about at least two preferential radially oriented axes. The frequency of these exciting forces varies with the piston speed which self adjusts to meet the power demand and is consequently unpredictable and varies within a large range. In conclusion, there appears to be no way to prevent the most outer located lands from making solid contact with the shaft, at least when only the four air pads discussed above are used.

The solution is to position another set of air cushions near both ends of the piston and arrange them so as to generate a restoring torque on the piston which opposes any tilting displacements thereof. A schematic diagram of such construction is illustrated in FIG. 18 in which two pairs of air cushion pads are shown located near the ends of tilting bar B articulated about axis 0. All air pads are supplied by a common source of high pressure air A and each is controlled by its own restricting orifice. These air pads are A1 and A1' on the left side of bar B, A2 and A2' on the right side. Their restricting orifices are respectively r1, r2, r4 and r3. It will readily be understood by readers familiar with the art why and how an angular movement of bar B automaticaly causes the pressure forces exerted on bar B to vary so as to generate a torque opposing that angular movement. Because the tilting torques imposed on the piston are of small magnitude and because these air pads are located near the ends of the piston, the sum total of the acting areas of the pads needs only be a small fraction of that of the four quadrant air pads.

Two sites are available to locate these anti-tilt pads: (1) at the end of the quadrant pads, and (2) on the piston outer face near the ends of the piston. The exact locations, approximate shapes and sizes of individual pads are indicated in FIGS. 6, 7 and 11 in dotted lines. FIGS. 7 and 11 are used to depict where these pads can be situated, FIG. 6 is used to show where the second choice locations are. In FIG. 7, pad areas are partially represented for one set of pads only as A1 and A2. The other three pad sets are located at equal intervals around the periphery of the piston internal cavity. The length and effective area of each quadrant air pad are reduced by the amount of area needed for accommodating the anti-tilt pads. In FIG. 11, the relative area of these pads is shown by the distances A1 and A2.

If the anti-tilt pads are located on the piston outer sliding surface, they must occupy areas located outside the various loop contours shown in phantom lines and which represent areas where these pads would interfere with ports and/or piston grooves. The dotted lines of their contours ⓐ, ⓑ, ⓒ, ⓓ, ⓔ, ⓕ and ⓖ are shown as an indication only of situs availability. The exact positioning, areas and shapes are such that the forces developed by each pad are equal, evenly distributed and in direct opposition, in the manner depicted for the quadrant air pads. In the non-tilting mode of piston motion, their effects add to the functions performed by means of the quadrant air pad operation.

Because the piston is not connected directly to a fixed part of the sleeve assembly, the high pressure air supply duct A of FIG. 18 cannot be directly connected to the inside 74 of shaft 100. Each type of anti-tilt air pads is supplied differently so as to best fit the configuration adopted. In all instances, the only accessible source of air pressurized to a high enough pressure level is the volume of spaces 65 (pressure $P_i$) and to which access is directly possible. For air pads A1 and A2, this can be done by open channels such as X linking a space 65 with pad A1 space as shown schematically and partially in FIG. 7. Channel X crosses through lands such as 68 of a quadrant air pad and the land surrounding a corresponding anti-tilt air pad so as to duct air at pressure $P_i$ into the anti-tilt air pad. Channels X are sized so that they also play the role of restricting orifices.

The peripheral length of the lands surrounding anti-tilt air pads is much shorter than the length of the lands confining quadrant air pads. The ratio of area covered by a pad to the length of its confining land is about the same for all air pads, though. In addition, the anti-tilt pads perform their anti-tilting functions only if and when the piston tilts. It was earlier explained that under such circumstances, the air pressures $P_i$ inside the four quadrant air pads do not vary appreciably, which is the cause of the need for anti-tilt air pads in the first place.

In FIG. 11, one typical $P_i$ air channel is shown by dotted line Y connecting space 65 to the location at one end of the piston where one anti-tilt air pad could be situated. Restricting orifice Y', accessible through its associated anti-tilt air pad, provides the pressure drop required for operating the air pad. In both types of anti-tilt air pads, in the actual piston construction, high pressure air supply duct A is replaced by one set of channels incorporating its own restricting orifice. With two air pad constructions being used simultaneously, quadrant and anti-tilt, the various pressure levels reached in these air pads are represented in FIG. 3. Whereas all of segment a-b of the $P_i$ curve is to be used if only quadrant air pads are utilized, this segment must now correspond to the two additive pressure drops in two restricting orifices mounted in series. Two intermediate pressure levels $P_i'$ and $P_i''$ exist between the pressure levels that correspond to points a and b. The quadrant air pads operate between pressure $P_i$ and the pressure level at point b-average $P_i'$, the anti-tilt air pads operate between pressure $P_i$ and the pressure level at point a-average $P_i''$.

With a proper dimensioning of the various restricting orifices and of the piston/sleeve and piston/shaft clearances, it can now be seen that the piston will never be allowed to contact either the sleeve or the central shaft. The clearance between the piston and the sleeve needs be only that which is required between the piston and the shaft plus a few thousandths of an inch.

In FIGS. 7 and 11, space 66 is shown as being the vented volume which surrounds the piston guiding groove and in FIG. 11, space 65 corresponds to the volume of a quadrant air pad. Circularly wrapped-around grooves 69 and 71 vent the air escaping the quadrant air pads. Such a venting groove system is also provided around the anti-tilt air pads. The major reason for such venting is to insure that the lands confining all air pads play the same role and has the same influences, whatever the local amount of clearance created between the cooperating piston surfaces and the shaft/-sleeve surfaces at any point during the piston motion. This defines and delineates the quasi constant degree of feedback control that exists at any time between the piston displacements and the restoring forces and moments generated by the air pads.

Air Bleed-off, Cooling and Isolating Functions

The amounts of high pressure air needed by the air cushions are far greater than the amount of air required by the piston detection system. For the purpose of the discussion, bleed-off air thus refers to the air expended through the air cushion pads. A certain amount of local cooling, or more properly, isolating is provided by this air. It is vented partly back into compressed air and partly into combusted gas. Thus the energy expended for compressing this air from atmospheric pressure to compressed air delivery pressure is mostly recovered. Though, the amount of energy expended to compress the compressed air to high pressure level is mostly lost. An optimum compromise exists between the restricting orifice sizes and piston/sleeve-shaft clearances, the air pad areas and the shaft diameter, and the pressure level of the high pressure air to which the compressed air pressure must be further elevated. A detailed analysis is beyond the scope of this disclosure. However, the benefits derived from this energy loss are deemed to far outweigh the concomitant engine efficiency loss. The proper perspective from which such loss can objectively be viewed is to compare such air bleed-off to that which is inherent in gas turbines. There, it is needed to isolate the hot combustion gases from the combustion chamber walls and to accommodate clearance space between the blade tips and the structural outer ring surrounding the turbine. In the present invention, it eliminates lubrication and truly minimizes wear.

Another important role is played by the air escaping the air pads, besides a very minimal cooling. It prevents combusted gas particularly and compressed air from entering the clearance spaces between sliding surfaces and the introduction of foreign matter therein. The high pressure air is not only pressure regulated but also filtered to eliminate solid particles, volatiles and/or liquids which may cause gummy deposits to accumulate in critical locations: i.e. recess D of FIG. 4, restricting orifice throats, etc. . . . Certain amounts of solid particles and condensible volatiles are always present in air, fuels and especially combusted gases. It is impossible to eliminate those. However, it is possible to insure that they are not introduced in places where they could cause problems, mostly of clogging and/or abrading natures. The constant flow of clean cooler air at higher pressure through these critical spots is constantly pushing away the carriers of such unwanted foreign matters and keeping them out. After operation, during the cooling down period, volatile fractions present in the com- -bustion member condense and form gummy residues that harden when heated during subsequent engine runs and in which solid particles may become embedded. For that reason, when the engine is turned off, the high pressure air flow should be maintained for a short moment hence so as to flush out the gaseous residues left inside the engine. The absence of lubricating oil of course eliminates a major source of such volatile fractions which are always present in internal combustion piston engines.

It must be pointed out that all high pressure air circuits are always open for this air to flow through. The air supply is turned on prior to starting fuel injection and ignition initiation as the engine is being cranked up. When the engine "fires", the air cushions are ready to operate, the combustion member internal volumes have been flushed out and condensed volatiles all have been also blown out of critical narrow spaces. Such operational steps are of great importance and are made part of the starting and stopping cycles of the EC engine of the present invention, as later described and discussed.

Operation Modes of the Combustion Member and Cycles

For all combustion engines in which fuel is burned to heat compressed air for producing hot combusted gases to be expanded back to ambient pressure, the cycle thermodynamic efficiency represents one essential aspect of the specific fuel consumption. The latter may be defined as the amount of fuel required to produce one unit of externally usable energy. It is generally the object to maximize this thermodynamic efficiency for a given set of engine operating conditions. The latter qualification usually translated decades ago into: "for the lowest overall operational cost"; economics being generally "the bottom line". However, conditions of prime importance one day, may become ancillary the next, so to speak. Two cases in mind occurred during the last decade and a half: (1) the cost of crude oil, and (2) the predominance taken by air pollution. In both instances, prevalent positions and attitudes regarding automobile propulsion changed radically, willy nilly, because of circumstances imposed on nations of the western world, in one case externally, in the other internally. Thus it would be foolish and unwise to simply state that maximizing the thermodynamic efficiency of a car engine is the only ultimate meaningful aim of any new engine concept.

A brief discussion of what that aim should most logically be is now in order. Fuel cost, availability and dependency, air pollution and engine operational costs delineate the areas of greatest importance and interest. For most of the largest industrial nations, except the USSR and its satellites, in this order: Japan, Western Europe, the USA; the cost and availability of crude oil are vital, the dependency on some developing and unstable nations which it creates could become crucial, in the long term, to world peace. The first and prime factor to consider is a reduction in fuel consumption and/or the substitution of fuels derived from sources other than crude oil. This can be translated into being able to burn a wider variety of fuels of lower grades, this can be achieved if less is demanded of the combustion process.

Liquid fuels, especially gasoline which is the most volatile of the most commonly used fuels, are responsible for two main pollution mechanisms: (1) vaporization, and (2) the chemical reaction which takes place between nitrogen and oxygen at the combustion temperatures reached in gasoline engines. Gasoline vapors generates air pollutants that result from chemical reactions which take place in the atmosphere under the influence of sun rays. It is more predominant in places where atmospheric inversion layers prevent natural ascendance of lighter-than-air gaseous fractions into higher regions of the atmosphere. Nitrogen and air react at the temperatures reached by the stochiometric combustion of gasoline to form complex variants of nitrous oxide, commonly referred to as $NO_x$. This chemical is the worst form of air pollutant produced by gasoline engines. Its elimination is thus a major aim.

Both pollution mechanisms have a common source, one indirect and the other direct. That common source is the fuel volatility which is required to form mixtures with air easy to ignite and that can best be ignited when the ratio of air to fuel is close to stochiometric (ideal ratio between air and fuel for which fuel combustion is theoritically complete without excess of oxygen). The latter means that the temperature of the combusted gas thus formed is the highest that can theoretically be obtained. In order to maintain a gasoline piston engine in good operating conditions and to make it perform satisfactorily, air/fuel ratios must be adjusted and kept close to that stochiometric ratio on the richer side. The obvious question then arises: why let the fuel ignition be—or remain—the primordial factor of the combustion process? In Diesel engines and gas turbines, the combustion process is such that this stringent requirement does not apply. For gasoline engines, the performance race pushes for faster rotating engines with higher compression ratios. The end result is less error acceptable on ignition timing and less time available to complete the combustion, hence more narrowly specified fuels of higher "quality" (octane number for instance). Lead helped for a while, but it is becoming more of a NO-NO also as its risks also became better assessed and more and more unacceptable. Turning back became an impossibility long ago as the search for solutions took the direction toward "technological fixes" which do not address the cause of the problem: the combustion timing must still be directly and exactly tied to the piston movement.

The solution to the combustion process problem obviously lies elsewhere. It must be slowed down and made less dependent on timing, rendered more flexible and more loosely tied to the power level demand. Those are the objects of the present invention: (1) longer combustion time, (2) less critical timing of the combustion initiation, (3), mechanical decoupling of the power delivery system from the combustion system, and (4) a concomitant reduction of pollutant content in the exhaust gases. Such an engine requires that it be physically split into two major components: (1) the combustion member, and (2) the motor which comprises the means for compressing the air, the means for expanding the combusted gas, the means for extracting power therefrom and delivering it for compressing the air and driving a power shaft. Because of the physical separation of the compressed air from the combusted gas, it is easy, simple and efficient to insert a heat exchanger between the hot combusted gas and the cooler compressed air. That heat exchanger can also play the role of surge or storage tank so as to introduce some degree of flexibility between power demand and power delivery. Such overall system is described and discussed in detail in my two previous U.S. Pat. Nos. 4,399,654 and 4,561,252. Thus the present discussion deals more specifically with the operation and characteristics of a lubrication-free dynamic combustor using a free piston riding on air cushions and of the control thereof.

FIG. 16 was described and discussed in the previous section along with the various thermodynamic cycles represented therein. Two basic cycles represent the two basic modes of operation that are possible with the engine of the present invention. A DAVID-I Cycle in which an "explosion"-type of combustion is facilitated, and a DAVID-II Cycle which corresponds to a Diesel Cycle engine having the equivalent of a turbo-charger. A DAVID-I Cycle is more closely related to an OTTO Cycle engine, also equipped with the equivalent of a turbo-charger. In both instances, some energy is lost on account of the bleed-off compressed air and further compression to a higher pressure. In FIG. 16, it is represented diagrammatically by narrow area A situated between solid line 2-3-4-5 and phantom line 2-7 below the solid line. For the purpose of the following discussion, whenever appropriate and justified, points 3 and 4 are assumed to lie on the phantom line curve.

In the DAVID-II Cycle, the fuel combustion is regulated by means of the fuel injection which is programmed to produce combusted gas at a rate such that the pressure in the combustion chamber remains constant or slightly decreases as the free piston moves toward the other end of the sleeve (similar to Diesel Cycle). Thus the admission of compressed air does not really have to absolutely cease when the valving means introducing compressed air "closes"; combusted gas cannot back up through the clearance always present between the piston and the sleeve. The peak temperatures reached in the combusted gas are of the order of those characterizing Diesel engines, which sets a limit on attempting to raise temperatures as a means of increasing the specific power capability of such engine. It also implies that some excess compressed air is always available.

In a DAVID-I Cycle EC engine, less excess compressed air is available and the fuel is injected more rapidly during a shorter portion of the piston travel. The pressure rise in the combusted gas volume is rapid upon ignition of the air-fuel mixture, and is referred to as explosion in a pure OTTO Cycle engine for that reason. The total amount of fuel is injected prior to initiating ignition. However, in a DAVID-I Cycle, the piston has already moved an apreciable distance from the end of its previous stroke when fuel injection stops and ignition occurs. Fuel combustion happens in a time much shorter than in a DAVID-II Cycle as the piston proceeds on its travel. During the time period when the combusted gas pressure exceeds the compressed air pressure, the check valve located upstream of the air admission valving means remains closed because of the pressure differential just mentioned. It may open if and when the combusted gas pressure decreases below the level of that of the compressed air. Then, until the air admission valving means automatically closes, some fresh compressed air is introduced in the combustion chamber where the explosion just took place. This excess air dilutes the combusted gases and immediately brings their temperature down. In the cycle curves of FIG. 16, the end result of these is summarized by indicating that cycle peak pressure $P_m'$ (DAVID) is lower than cycle peak pressure Pm (OTTO) as shown by point 6 as compared to point 2. It might appear from the above that a DAVID-I Cycle is so similar to an OTTO Cycle that it offers no advantage from the standpoint of improvements over the gasoline engine as earlier claimed. Some further clarification is needed here.

The time durations allowed for all functions (fuel injection, ignition, combustion, air/gas mixing, etc . . . ) is between five to ten times those which a comparable gasoline engine permits. The fuel is injected in compressed air at a temperature higher than that which would exist in a comparable gasoline engine, because of the heat exchange taking place in the storage tank, which facilitates the fuel vaporization. However, the nature of the fuel needed by a DAVID-I Cycle is different from that which a DAVID-II Cycle EC engine requires. These fuel natures range from gasoline to Diesel fuel for DAVID-I Cycle EC engines, and from Diesel fuel to crude oil for DAVID-II Cycle EC engines, well known petroleum products being used as a comparison yardstick. It should also be noted here that when properly equipped (check valve) and with appropriate power control adjustments, the same free-piston EC engine with automatic valving can run according to either a DAVID-I Cycle or a DAVID-II Cycle. For easy comparison and understanding of these two cycles, Table A below summarizes this information.

TABLE A

CYCLE COMPARISON CHART

| PISTON POSITION (in "degrees") | DAVID-I ("OTTO") | DAVID-II ("Diesel") |
|---|---|---|
| 0 | Cycle starts, piston reverses direction, both cases. | |
| 5–7* | Compressed Air admission starts, both cycles. | |
| 8–10** | Fuel Injection starts, both cycles. | |
| 10–20 | Fuel Injection | |
| 10–60 | | Fuel Injection |
| 18–22 | Ignition | |
| 10–30 | | Ignition |
| 12–65 | | Slow Combustion |
| 23–35 | "Explosive" Combustion | (combustion pro- |
| 26–50 | Check Valve closed | ceeds during most |
| 60–90 | Check Valve may open | of this time) |
| 65–70 | | Combustion stops |
| 90–110 | Arbitrary but fixed closing of the Compressed Air admission automatic valving means, both cycles. | |
| 155–160 | Combusted Gas Outlet valving means opens, both cycles. | |
| 170–175 | Combusted Gas Outlet valving means of opposite combustion chamber which was open closes, for both cycles. | |
| 160–170 | Minimum Time during which Combusted Gas Outlet valving means are open for both combustion chambers, for both cycles. | |
| 160–345 | Piston "travel" during which the Combusted Gas Outlet valving means remains open, both cycles. | |
| 180 | Time when and Location where the piston completes its first stroke S and reverses direction, for both cycles. | |
| 180–360 | The above-described full-stroke cycle repeats for the piston return along the opposite branch of the guiding quasi-elliptical groove. | |

NOTES:
*although no "crankshaft" is present in the case of a free-piston EC engine, the conventional method of indicating piston position in an angular fashion is still used here for the sake of easy understanding and convenience sake.
**when two angular positions are indicated, an approximate range is meant, as a reference.

The highlights of the information contained in Table A need be discussed now. The opening phases of the combusted gas outlet valving means of both combustion chambers overlap. This signifies that there is no interruption in the delivery of combusted gas. However, it does not mean that combusted gas then flows from one chamber back into the other. The piston has reached a velocity which is almost constant at the beginning of the fourth quarter of stroke S and the pressures existing in both combustion chambers are then not very different, for either cycles, during steady-state engine operating conditions. The reason is that the frictionless piston only serves to equalize the pressures applied on its end faces. Pressure differences between the two chambers only resist inertia forces on the part of the piston, causing it to either accelerate, decelerate or slide steadily as the case may warrant. This is especially true in the case of the DAVID-II Cycle. In the case of the DAVID-I Cycle, because of the "overpressure" generated by the "explosive" combustion, a less steady motion of the piston may result, mostly during the third quarter of the piston stroke. It should be emphasized at this juncture that the average delivery pressure of the combusted gas to the storage tank is the same for both cycles, though slightly more fluctuating in the case of a DAVID-I Cycle.

One may wonder whether a DAVID-I Cycle then presents any advantage. The answer is that it cannot be significant from a thermodynamic cycle efficiency standpoint. However, it definitely is from a practical one based on fuel availability. Gasoline is not going to disappear overnight and newer inexpensive cruder fuels are not going to be readily available everywhere. A transition period of at least five to ten years would be needed for converting car powering from IC to EC engines. Gasoline could be injected like Diesel fuel and be burned in a DAVID-II Cycle engine as well. Possibly, but for reasons similar to some of those which preclude the use of gasoline in Diesel engines, it cannot be ascertained whether it would be desirable, or not. A more detailed discussion of the subject is beyond the scope of the present disclosure.

The second highlight is that the use of a check valve in connection with a DAVID-II Cycle will allow a faster fuel injection and faster combustion, and a concomitant combusted gas peak pressure higher than the compressed air pressure. This will cause a higher rate of acceleration of the piston during the stroke second quarter, possibly resulting in the piston reaching a constant velocity earlier during its stroke. The use of a check valve at the entrance of the compressed air admission valving means offers an additional degree of flexiblity in the control of the piston axial motion.

A third highlight worth mentioning is that a check valve can also prove beneficial when installed downstream of the combusted gas outlet valving means during engine deceleration periods, but that it will not affect the communication established during the 160–170-degree interval during which both combustion chambers interconnect. This interconnection is established within the piston and through the sleeve walls. The cross-section shown in FIG. 10 indicates how such connection is formed in manifold space 84 of the sleeve. Two check valves, one in each location X and Y on either side of duct 83, would be required to shut off such connection. Such extra complexity may not be justifiable however.

The fourth highlight is that the time allocated—and available—to fuel burning in a DAVID-II Cycle can be four to five times larger than that which is allowed for the "explosive" fuel combustion of a DAVID-I Cycle. Finally, it should be noted that the duration of the opening of the compressed air admission valving means is fixed by the design of ports 31 and 37 (or 41 and 47). Making them shorter will reduce the duration, in "degrees", of their opening. The timings and durations of other functions can be proportionately reduced or adjusted. The possibility of such adjustments is of particular interest in the case of an engine specifically designed to operate exclusively on a DAVID-I Cycle, so as to give the piston more time to reach its constant velocity during the remnant of its stroke.

The compression ratio of a free-piston EC engine is not related to and/or dependent upon the combustion member operation. It is determined by the compressor portion of the motor. It is believed that vane motors are limited in the amount of compression that they can perform per stage and across each vane. Both the numbers of vanes per stage and of stages for an engine have practical values beyond which an increase of these numbers becomes ineffective. The number of stages probably should not exceed 3. The compression ratio per stage is probably limited to 2.5/1. It means that the practical maximum compression ratio obtainable is $(2.5)^3$ or 15.625/1. Because of interstage pressure losses and various other causes, a realistic maximum compression ratio of 14/1 could be obtained with three stages. Three stages for a compression ratio of 2/1 per stage yield an overall compression of 8/1. Two stages with a compression ratio of 3/1 yield an overall compression ratio of 9/1. It seems realistic to expect compression ratios similar to of current gasoline engines but somewhat lower than those of Diesel engines, required for self ignition. In spite of the preheating of the compressed air provided by the heat exchanger, it would be unrealistic to expect that self ignition is routinely attainable in free-piston EC engines. A piston-type motor would be required. Such a trade-off does not seem attractive. The digression above serves to point out that neither of the two appellations "OTTO" and "Diesel" used herein have any connotation related to compression ratio levels or self ignition. They are used only to establish the basic differences, although minor, between the DAVID-I and the DAVID-II modes of operation.

For both cycles, the regime (or frequency, or piston average velocity per stroke) of the piston motion is strictly and only dictated by the demand made upon the combustion member for combusted gas. The dynamic combustor neither draws compressed air from an infinitely large source at constant pressure nor does it dump combusted gas at constant pressure into an infinitely large sink. Thus the conditions existing in the storage tank, the setting of the air intake valve and the amount of fuel injected per piston cycle determines the average pressure differential across the piston, hence its average velocity and its regime. That average pressure differential may be regarded as the equivalent of the pressure drop needed between the compressor outlet and the turbine inlet of a gas turbine, and which represents the combustion pressure drop. Viewed in that light, the advantage of a frictionless free-piston becomes obvious.

Although the piston must reverse its direction twice every "360-degrees" as indicated in Table A, that direction reversal is gradual. Axial velocity (and concomitant linear kinetic energy) is transformed into angular velocity (and concomitant rotational kinetic energy) twice and vice-versa twice also. In addition, at the end of each stroke, the piston is slowed down by means of an elastic bumper which stores energy and gives it back to the piston when it has reversed its direction. The relative importance of the role played by the guiding-stub/groove assemblies to that played by the pneumatic bumpers now deserves a short qualitative discussion, being both essential to the free-piston dynamic operational behavior. If the piston velocity is too low when it reaches a bumper, the piston will bounce back without "crossing over" to the other groove branch or side. If the bumper reacts too strongly and too fast, the same thing happens. In both instances, the piston must be stopped and started again in the correct direction. Such procedure is unacceptable if piston cycles need be interrupted too often. On the other hand, if the piston velocity is high and/or the bumper does not elastically absorb enough kinetic energy, the piston is caused to reverse its direction at too high a velocity; too much axial kinetic energy must be transformed into rotational kinetic energy. This imposes higher loads on the guiding stubs and the groove walls at locations where stresses are already always the highest, which is undesirable. The piston then also starts its subsequent cycle at too high a velocity. Thus a proper balance must be created between the portions of that burden which the bumper and the piston guiding system must share.

The apportioning of this load sharing is function of the piston velocity when it engages the bumper and of the peak pressure generated in the bumper space at some time before the piston reaches the end of its stroke. FIGS. 6, 11, 13 and 14 indicate a preferred manner in which such apportioning can be programmed to provide this load share balancing. The piston velocity is calculated by a central processing unit (CPU) that receives signals generated by pneumatic sensors previously described which indicate the times at which the piston passes by two ramps especially positioned in the guiding grooves: one at 110°, the other at 145°, on one side, and 290° and 325° on the other side (Table A); providing a "35°" piston-stroke segment to divide by the time taken by the piston to travel from one ramp to the next for computing the piston average velocity between these two reference points.

It was previously stated that the piston velocity reaches its most constant value about the beginning of the fourth quarter of the piston stroke (135°" and "315°"). The intervals 110–145 and 290–325 both straddle these values, thus the computed values of the piston velocities represent fairly well a measure of the kinetic energy to be absorbed and/or transformed. In FIG. 6, quasi elliptical track ② is used to show the locations of these sensing ramps. They are referred to as r1 and r2 on the left and r1' and r2' on the right. Other reference cycle points of interest mentioned in Table A are also shown and are easily identifiable.

The average piston velocity thus computed is processed by the CPU to determine the peak pressure level that can be created inside the bumper space before the piston reaches the end of its stroke. A relief valve RV shown in phantom lines in FIG. 13 is monitored by the CPU so as to set the pressure level at which it opens to let trapped gas escape from bumper space SB back into the combustion chamber through channels C1,C2 and C3, while maintaining the pressure level set by the CPU/relief-valve cooperative combination. In addition, pressure relief check valves RV' are also used to vent space SB overpressure into internal volume 85 (FIG. 11). A small orifice—not shown—connecting space 85 with the combustion chambers insures that piston internal volume 85 slowly vents back into one combustion chamber. Relief valves RV' operate only when the pressure in space SB rises above the level set for relief valve RV and serve also as safety valves.

The share of piston kinetic energy handled by the bumper is thus established at the end of each piston cycle. The difference between the total kinetic energy of the piston and that share is handled by the piston/-sleeve guiding system, and represents the balance of axial kinetic to be transformed into rotational kinetic energy, and then immmediately back into axial kinetic energy in the opposite direction. At very low piston velocities, e.g. engine idling speed, the piston needs not be slowed down by means of the bumper action. Thus the pressure level setting computed by the CPU may be lower than the pressure in the combustion chamber and relief valve RV remains fully open. The piston guiding system absorbs and transforms all of the piston axial kinetic energy. One might say that, under steady-state operating conditions, the loading of the piston guiding system at the stroke ends is established to remain at or below a quasi constant level which corresponds to the design loading conditions of the stub/grooves.

It is obvious that the clearances between the sliding surfaces of the bumper play a vital role in the bumper effectiveness. Those clearances can never be repeated from engine to engine or remain constant during the life of the engine, because of wear, gummy deposits, etc. . . . The peak pressure adjustments performed by means of the CPU and relief valve RV take care of such variations in bumper characteristics. The bumper radial clearance may be made smaller or larger than the radial clearance existing between guiding shaft 100 and the surfaces of the lands around the piston internal air cushion pads. In order to minimize or eliminate wear altogether, it is preferable to have the bumper radial clearance larger than the air pad land clearance. On the other hand, such a construction might not provide rapid enough a buildup of the pressure of the combusted gas trapped in the bumper, and not insure adequate piston braking action at lower piston velocities. It is impossible to indicate at this juncture which design tradeoff is most promising. In any case, the truncated conical chamfer CH located at the end of the bumper male part facilitates the engagement of the bumper female counterpart in the event that the bumper radial clearance is smaller than the air-pad-land/shaft radial play, and to take into account the cumulative effects of tolerance build-ups.

Piston Clamping, Starting and Stopping

As discussed in my two previous U.S. Pat. Nos. 4,399,654 and 4,561,252, the free piston must be stopped and timely released at the times the engine is turned off or switched on. This is due to the facts that the piston motions (axial and angular) are both used for timing other functions vital to the proper operation of the dynamic combustor and that these function timings are not symmetrical with respect to the piston transversal plane of symmetry; hence the need for and the coordination of these two motions. As earlier mentioned, during normal engine operation, when the piston does not return along the assigned branch of the quasi ellipses, it must be stopped, repositioned and restarted in the correct direction. This is accomplished automatically by the engine control system and is possible because: (1) compressed air and combusted gas are stored in the heat exchanger in enough amount to adequately compensate for a few missed combustion cycles, and (2) the motor hardly feels the change of pressure conditions in side the storage tank and is not mechanically connected to the free piston.

It would not be practical to keep either compressed air or pressurized combusted gas in the storage tank when the engine is turned off. No compressed air is available when the engine is switched on, but the motor compressor can deliver compressed air at full pressure even when rotating slowly, contrarily to a gas turbine, because the compressor is of the displacement type. The compressed air compartment of the storage tank can thus quickly be filled with compressed air at full pressure by cranking the motor for a few seconds. Cranking assistance is provided for a few more seconds after the piston has been released and combustion has begun. The clamping system needed for positioning, holding and then releasing the piston thus is of vital importance to the operation of the free-piston dynamic combustor. It is best described by the drawings of FIGS. 13 and 14.

When the engine operates, hooks 105 are retracted and the male portion of the bumper exhibits a smooth surface free of protrusions, plunger 108 being also in a retracted position. Clamping is achieved by pushing plunger 108 to the right, which forces hooks 105 to extend outwardly. This should happen only when grooves 115 are positioned correctly, otherwise the piston is not clamped or worse would be free to slam against the tips of the protruding hooks. On the other hand, plunger 108 cannot move to the right from a retracted position, if the hooks are not free to protrude freely through the conical surface of chamfer CH, because of the non-yielding nature given to the forced combined and coordinated motions of plunger 108, of the hook articulations 117, of the hook arm structures and of pushers 107 and 109 arrangement. In addition, the hooks are prevented from protruding if and when the bumper is operating—piston at the end of its stroke—while plunger 108 is being urged to move to the right, but being hindered in its motion because of pushers 107 and 109 being unable to negotiate their associated ramps on the plunger external surface. Obviously something has "to give".

The "giving" or complying feature required is provided by the coordinated and combined actions of one component and one system. The component is the plunger actuating mechanism. The system is the control of the clamp actuating mechanism. Firstly, piston 112 responds to pneumatic forces which have a "springiness" in their actions. Secondly, a command to plunger 108 to extend out can only be given by the CPU if and when the piston has reached and gone by the sensors in the guiding grooves that are located at the ends of the long axes of the quasi-ellipses, and only for those ends which correspond to the bumper being operating. When such conditions are met, a signal is generated by the CPU and sent to the control valve monitoring the plunger displacements. At that time, grooves 115 are still located halfway between the two ends of the bumper male part and the tips of hooks 105 drag on the internal surface of the bumper female part. As soon as the hook tips are free to move outwardly when grooves 115 pass by, piston 112 and plunger 108 are urged to move a very short distance which causes the hook tips to fully engage the left flanks of grooves 115. The cooperating matching slanting inner faces of the hook tips and of the grooves urge the hooks to further enter the grooves, so as to fully secure the clamping of the piston. It should be noted at this juncture that articulation 117 is constructed in a manner such that: (1) it cannot jam or seize, (2) it allows very little sideway movement in any direction (usual play), and (3) it allows radial displacements of the hook arm structures so to accommodate adjustments in the relative positions of the hooks in their respective cooperating grooves.

Plunger 108 is terminated by a cylindrical protrusion PR that penetrates a cooperating cavity CA at the end of its travel. The role of this coperative action is dual: (1) to provide a guide and support to the otherwise unsupported free end of plunger 108, and (2) to dampen the shock that the plunger would otherwise experience when reaching the end of its travel. This also enables the plunger cylindrical surfaces to center the hooks by means of pushers 107 and 109. At that point, the free piston is fully restrained in its axial motion mode by the hooks and in its rotational motion mode by the guiding stubs and their grooves. The CPU also has been informed that the piston is positioned properly to start the forthcoming piston cycle.

Engine Starting and Stopping

At rest, after the engine has been stopped, all volumes and/or internal spaces are filled with gaseous fluids at atmospheric pressure. Compressed air cannot be delivered to the combustor until the motor compressor is caused to rotate. This task is performed by a starter connected to the power shaft. The compressor is of the displacement type whereby air is substantially compressed to a fixed compression ratio regardless of its rotational velocity. The air intake valve 175 of FIG. 15 is closed. Thus, as soon as the starter is activated, the air compartment of storage tank 170 begins to fill with compressed air. The compressed air pressure builds up to a level at which the free-piston can start its operation. The piston is still clamped, but its location is such that the compressed air inlet port corresponding to the stroke end near which the piston is clamped is partly open. When the sensed compressed air pressure in the storage tank reaches a specified level, the air intake valve is caused to open a set amount to enable the combustion chamber at the end where the piston is clamped to receive compressed air.

The storage tank rapidly vents into that combustion chamber and the air pressure therein soon reaches the required level at which both the fuel injection and the release of the piston can be initiated. The high pressure compressor which had already been activated begins supplying high pressure air to all air cushion pads. Fully supported by the air cushions, the freed piston accelerates toward the other end of its stroke. The compressed air inlet ports open even wider to admit more compressed air as fuel is being injected. Depending upon the thermodynamic cycle mode of operation, fuel ignition is started almost immediately or later on (DAVID-I Cycle). Before the piston reaches its first midstroke, the fuel combustion is complete, compressed air admission is stopped and the piston accelerates until it reaches its full velocity somewhere near the end of the third quarter of its first stroke. During all this time, the other combustion chamber which normally would be vented to the storage tank through its combusted gas outlet ports is prevented from doing so by means of a shut-off valve SOV which is caused to remain closed until given a command signal from the CPU to open.

Because of minor leakage around the piston between the piston and the sleeve, and air escaping from the air cushion pads, some compressed air gathers in that second combustion chamber. It adds to the air originally therein at atmospheric pressure and that mixture of air is compressed by the free piston motion that acts to reduce its volume and concomitantly increase its pressure. The proper coordination of the previously mentioned starting steps insures that the air compressed and trapped in the second combustion chamber reaches a pressure comparable to that which its content normally reaches near the end of a piston stroke. The bumper located at that sleeve end can thus operate normally, stop the piston axial movement while insuring that the piston passes over to the other side of the quasi elliptical tracks. Operation of the first combustion chamber where the first fuel combustion already took place is proceeding according to normal running conditions. Shut-off valve SOV is caused to open when the signal is given that the piston has reached the end of its first stroke. Fresh compressed air is added to the air previously trapped in the second combustion chamber. The clamping hooks are of course kept retracted and the second piston cycle starts concurrently with its second stroke.

From the end of the first piston cycle onward, combusted gas is delivered to the storage tank. Another shut-off valve may be provided between the storage tank and the motor. If that is the case, it is kept closed until the combusted gas compartment of the storage tank reaches its normal operating pressure, at which time it is caused to open and remain open. At that time, the gas expansion means of the motor starts producing power and the starter assistance may terminated. The engine motor has then reached its steady idle speed and the free-piston combustor has also reached its lowest steady operating frequency. The CPU causes the air intake valve to be adjusted back to its idling speed setting and the starter is disengaged and stopped. The engine starting operation is completed and power can be demanded thereof. This is generally accomplished by coordinating the air intake valve adjustment and the amount of fuel injected per piston cycle, as is discussed further on.

In the unlikely condition that the piston does not pass over the end of its stroke, as earlier discussed, the free piston bounces back and its travel is detected and monitored by the CPU. At the proper time during this backward travel, the CPU directs the shut-off valves to close and/or open in a sequence such that compressed air is introduced in the proper combustion chamber so as to properly position the piston so that the equivalent of a starting cycle may be repeated. It should be pointed out that this condition of momentarily stopping the piston does not correspond to the stalling of a gasoline engine. The vane motor still continues its operation with the cooperation of the storage tank contents. A comparison with a gas turbine flame-out condition seems more appropriate and offers more similarity therewith.

When the engine is to be stopped, its operator causes the ignition and the fuel injection to stop by means of the CPU. The air intake valve is caused to close when the piston reaches substantially its mid stroke position during the cycle immediately following that during which the switching off signal was given by the operator, in a manner such that the piston completes the second half of that stroke and passes over the end of its stroke at a velocity low enough to enable the clamping system to operate safely and satisfactorily. Upon the piston rebouncing on the correct guiding track, the clamping system is activated and the piston become clamped. Should the piston not reach the stroke end and not pass over it, a cycle is initiated by the CPU in a manner such that the piston is brought back to a clamped position as is described above, while compressed air is still available in the storage tank to accomplish this. Once the piston is clamped, the compressed air and the combusted gas still contained in the storage tank are allowed to vent to the outside. The high pressure air compressor is shut off and the CPU is turned off. The engine is then fully stopped. At rest, the free piston is thus locked in a fixed location and on the correct sides of its elliptically shaped guiding tracks, at either end of the sleeve, ready for the next starting cycle.

Because high pressure air is needed immediately as soon as the motor is being cranked, a small reservoir for high pressure air is always kept pressurized. This reserve supply of high pressure air is used during the short waiting time period that is required to fill the storage tank with compressed air. This is especially applicable if high pressure air is also used in air cushion pads/journals in the motor.

Engine Efficiency Loss and High Pressure Air Supply

Regardless of the type of thermodynamic cycle adopted, the energy loss caused by further compressing compressed air depends almost exclusively upon the value $P_1$ of the pressure level at which this air is supplied and upon the sum total of the areas of the air journal gaps through which the air escapes to various volumes pressurized at $P_2$. Pressure $P_1$ is determined by the load which the air pad journals must support or resist and which dictates the average pressure level $P_i$ needed in the journal spaces in conjunction with the area of the surfaces covered by the journals. The total cross-sectional area of the air gaps is the product of the total length of the journal confining lands by the average clearance provided between these lands and the surfaces along which they glide.

The set of equations derived below indicate how these design parameters relate to engine efficiency losses, depending on the dynamic combustor construction. The parameters of interest are:

- F—representing the peak loads to be reacted by the journals
- A—total area of the journal support surfaces
- L—total length of the journal lands confining total area A
- $\epsilon$—average gap between the lands and the supporting surfaces
- $P_1$, $P_i$ and $P_2$—air pressures previously defined
- K, K', K'' and C—various constants of no direct importance.

All equations below represent a first order approximation of the relationships existing between these various factors. $W_a'$, the weight of air flowing through the journal gaps is assumed to represent a measure of the energy lost in the air cushion pad operation. It is very roughly:

$$W_a' = K.L.\epsilon.P_i.(P_i - P_2)^{\frac{1}{2}} \quad (1)$$

The total load F is roughly proportional to the average pressure differential existing across area A, or:

$$F = K'.A.(P_i - P_2) \quad (2),$$

where:

$$P_i = (P_1 + P_2)/2 \quad (3).$$

L and A are geometrically related as follows:

$$L = K''.(A)^{\frac{1}{2}} \quad (4),$$

if the general shapes and arrangements of the journals do not vary appreciably with the extent of their effective surface areas.

The amount of high pressure air flow needs be expressed as a function of $P_1$, $\epsilon$ and F, assuming that $P_2$ is set and quasi constant for the purpose of this analysis. Combining equations (2), (3) and (4), and rearranging the various terms in equation (1), yields:

$$W_a' = C.(F)^{\frac{1}{2}}.\epsilon.(P_1+P_2)/2 \quad (5),$$

where a single constant C replaces K, K' and K'' and is equal to: $K.K''/(K')^{\frac{1}{2}}$. F is fixed for a given piston configuration and size, and a given pressure level $P_2$ at which the engine operates. Therefore, $\epsilon$ and the pressure level $P_1$ constitute the two most influential design factors that determine the loss in engine efficiency which represents the energy cost or penalty imposed by the use of pressurized air journals. It should be kept at a minimum. In terms of energy loss, $P_1$ appears twice in a compounding fashion.

Again as a rough approximation, the energy expended to pressurize compressed air increases both with the amount of air to be compressed and the degree of compression. Minimizing $P_1$ thus is of prime importance. Two combined approaches can be used: (1) increasing the area of the fixed size restricting orifices, and (2) increasing the diameter of guiding shaft 100; as a close examination of equations (2) and (3), and FIGS. 3 and 8 reveals. Readers familiar with the art will establish the connection, a more detailed discussion being beyond the scope of this disclosure. The value of $\epsilon$ is determined by piston design and construction and should now be discussed.

There are three factors of interest here: (1) the amount of part machining tolerances which are dictated by fabrication cost, (2) the nature of the materials used in those parts, and (3) the maximum temperature differences reached by matching parts. It is assumed that the influence of wear of and/or deposits on the sliding surfaces could be neglected and are consequently ignored. The second and third factors are directly related and determine in combination the amount of differential expansion taking place between part matching dimensions. The first factor is indirectly related to the other two factors. Practically, the parts must be machined to a nominal dimension with tolerances thereon. The value of the nominal dimension usually varies with the material temperature. Parts are assembled so that they must be positioned by means of intermediary parts which also exhibit tolerances and thermal expansion differences. The minimum clearance or play between two matching parts (e.g. piston journal land ID and guiding shaft OD) must always be large enough to accommodate the worst condition of tolerance stack-up combined with the worst thermal differential condition. In addition, when these two worst sets of conditions are combined in the worst possible way, a minimum degree of play must still be assured to insure a satisfactory operation of the air cushion journals.

The word worst in this context can have two meanings: either the largest clearance or the smallest clearance, depending upon the benefit or the penalty that is derived therefrom. Large clearances mean large high pressure air flows, whereas small clearances mean risks of physical part interference and/or too tight a guidance of the piston and too high a feedback gain of the automatic centering control of the piston, which could induce chattering of the piston on the shaft. In the above, distorsions caused by temperature differences within a part have been ignored, though they might create a misalignment of some parts. The reader will appreciate the complexity of such an analysis and also why materials with a very small or nil coefficient of thermal expansion should first be investigated and considered for application in the construction of the piston, the sleeve and the guiding shaft. The nature and selection of such materials are discussed later on. The influence of thermal differential expansion will now be provisionally neglected. Discussions of $\epsilon$ and of its variation are limited to machining tolerances and their stackingup so as to better define the degree of energy loss resulting therefrom. Part dimensional matching is assumed to be applicable in the following, which applies to the sleeve ID, the piston OD, the shaft OD and the piston journal land ID, so as to keep the tolerances on respective clearances within 0.001 inch. Dimensional matching is not practical to consider for concentric ID - OD combinations, which occurs twice in a piston-sleeve assembly: (1) between the piston OD and the piston air journal land ID, and (2) between the shaft OD and the sleeve ID. The latter intervenes by means of the sleeve closing ends, which introduces another potential source of tolerance stack-up on the concentricity of the sleeve ID and shaft OD axes. A total radial tolerance of 0.004–0.006 inch must be allocated to this source of uncertainty. The total variation in the possible amount of radial clearance which must be provided between the OD of the shaft and the piston air journal land ID must be at least twice that much, say up to 0.010 inch. If a minimum clearance of 0.002 inch is to be insured at all times between the piston OD and the sleeve ID to avoid risks of possible contact therebetween, the total mean amount of play that must be provided between piston and sleeve is 0.010+0.002 or 0.012 inch radially, minimally, assuming part matching and no differential thermal expansion. Under such ideal conditions, air at pressure $P_i$ is presented gaps of 0.012-inch average height and the gaps between the piston OD and the sleeve ID could vary between 0.002 and about 0.009 inch at randomly located points, at any time. This averages at roughly 0.006 inch radially.

As a result, three types of leakage may cause energy losses: (1) the high pressure air flow around the piston guiding shaft, (2) the blow-by flows around the piston, and (3) the high pressure air flow around the piston if torque air pads are located on the piston outer cylindrical surface. The last air leakage flow can be eliminated by locating these air pads beyond the air journal pads, at their ends and facing the shaft surface, as earlier mentioned. Two major causes of energy loss remain to be assessed, this should be done separately.

The second source of loss corresponds to compressed air flowing directly into combusted gas at lower pressure and by-passing the combustion process, or to combusted gas at higher pressure—DAVID-I Cycle operation—flowing directly into compressd air at lower pressure. The second leakage mode is practically inexistant in the case of a DAVID-II Cycle operation, the pressure differential across the piston being always relatively small. It is not the case for a DAVID-I Cycle in which the combusted gas pressure peak appreciably exceeds the compressed air pressure, but worse, the peak combustion temperatures are higher. It unlikely that the jetting of hot gases through the narrow passages between sleeve and piston surfaces could ever be considered. Another piston guiding system must be used in DAVID-I Cycle EC engines. A suitable construction is presented and discussed later. If restricted to DAVID-II Cycle EC engines, a central guiding shaft system should cause amounts of blow-by of no appreciable significance.The energy loss resulting therefrom may be ignored.

The energy loss caused by high pressure air leakage—called leakage maybe improperly, because it actually is a servo-flow—around the guiding shaft is thus the only loss of importance. In the alternate piston-support configuration presented later,it is shown that this loss could however be reduced by a factor of at least three, but which creates minimal amounts of friction and part wear. For this reason it is worthwhile to discuss the relative importance of the larger leakage flow first. One should first keep in mind that only a relative evaluation of the energy loss is needed and can be made here. Secondly, the purpose of the evaluation is to compare qualitatively alternate free-piston combustor constructions. The aim of the air "journal" approach to supporting the piston is to prevent friction, its attendant energy losses and heat production, and wear of sliding surfaces. The side loads exerted on the piston are a small fraction of those which a comparable piston in an IC engine would apply on its sleeve. They are created by the small differences between the pressures applied laterally on the piston. These vary locally and temporally as the four ports come in or out of registering. One can attempt to assess the extremes of these pressure differences and the areas onto which they are applied. FIGS. 1 and 6 give an indication of these areas: less than 5% of the piston cylindrical surface. The maximum pressure differences applied thereon correspond to less than 10% of pressure $P_2$ peaks.

The side forces thus vary between $+0.005$ and $-0.005$ of the product $\pi D.L'.P_2$, if D is the piston OD and L' its length. The corresponding peak axial load on that piston is approximately $\pi D^2.\Delta P_2/4$, if $\Delta P_2$ represents the peak pressure difference between the two pressures applied on the two opposite faces of the piston. That pressure difference may reach 10% of $P_2$, as one must remember that no energy is extracted from the piston motion and that it only plays the role of a "diaphragm" transmitting pressures. Then the peak axial force is roughly $0.08D^2.P_2$. A reasonable and likely ratio between L' and D is between 1.5 and 2 for such a free piston. An average ratio between the side forces and the axial forces exerted on the piston are then about 10% to 12%, the axial force being 5%–7% of those of a comparable Diesel engine. $P_2$ is used as a basic or reference pressure, being common to the piston moving motivator and the piston lateral support air journals, both in direct ways.

Two major conclusions can now be drawn: (1) the side force peaks are between 25 and 35 times smaller than they would be for a comparable Diesel engine piston, and (2) the side force peaks are about 2.5% to 3% of $D^2.P_2$. An examination of FIGS. 1, 2 and 6 reveals that the diameter d of the shaft is about D/3 and that the effective length of the air journals is roughly 2D/3,whereas its effective area is about $\frac{2}{3}$ of that. Thus the effective area on which $P_i$ is applied is $D^2/7$. If the maximum variations of $P_i$ are kept below half of $(P_1-P_2)$, the variation $\Delta P_i$ needed to balance $0.03D^2.P_2$ in either direction is $(P_1-P_2)/4$. One then has: $(P_1-P_2).D^2/7=0.12D^2.P_2$. Solving for $P_2$ expressed as a function of $P_1$ yields $P_1=2\ P_2$ approximately. Air for the journals must then be supplied at about twice the compressed air delivery pressure, in the case of the free-piston combustor construction illustrated in FIGS. 1, 2 and 6.

$P_1$ and $\epsilon$ are now quantatively known as a function of the measure of engine energy $P_2$, although estimated only qualitatively. Referring back to equation (5), one sees that the high pressure air servo-flow is proportional to $\epsilon.P_2$, for a given piston. Further, $P_1=2P_2$, the energy delivered by the engine is proportional to $P_2$ energy required by the compression $P_1/P_2$ is also function of $P_1/P_2$ and $W_a'$. The answer sought comes from ratioing these two energies. Some simplifying assumptions are needed at this juncture: (1) an estimate of the relationship between engine power and $P_2$, (2) an estimate of the relationship between compression power and compressor output (pressure and air flow), and (3), an estimate of the energy lost and/or gained back externally to the air journals.

Another factor comes into play at this juncture: the piston average velocity or its to-and-fro motion frequency. A purely intuitive and succinct reasoning will illustrate this: if the piston does not move, no engine power is produced, however power is needed to compress the air which continuously flows through the $\epsilon$ gaps. The ratio of the latter to the former is infinite. In other words, an engine power level must now be established for which the following has meaning. Arbitrarily, the half-power point is assumed to be representative of the average use and/or operation of such engine, as is the case for most IC piston engines.

For the purpose of this discussion, the following operation parameters and conditions are assumed to represent this halfpower setting: (1) piston frequency, 10 cps; (2) piston stroke, S=1 ft; (3) piston diameter, D=5 inches; (4) average piston velocity, vp=20 ft/sec.; (5) engine overall efficiency 30%; (6) high pressure air compressor efficiency 80%; (7) air pad gap; $\epsilon=0.010$ inch; and (8) $P_1=2\ P_2$, as earlier defined. A simplifying assumption is also made: energies may be roughly represented by the product of pressure by volume, a piston stroke being used as the time unit. The influence of atmospheric pressure is neglected and ignored in the following.

The amount of energy stored in the combustor and potentially available ultimately as shaft power is 30% of $\pi/4(D^2).S.P_2$, as elastic energy stored to be later extracted by the expansion means. The amount of energy needed to compress the high pressure air to $P_1$ from $P_2$ is roughly $2P_2.V$, if the volume of air at pressure $P_2$ which escapes through gap $\epsilon$. This volume V must now be expressed as a function of D and S so that these two energies may be compared numerically in a meaningful manner.

The pressure forcing air to flow through gap $\epsilon$ is $P_i$ that is nominally 1.5 $P_2$. Thus air is expelled through gap $\epsilon$ at an average velocity va which can be estimated to correspond to a pressure expansion ratio of 1.5 through an orifice having a low coefficient of discharge. It is assumed that, under such conditions, a realistic value of va is 400 ft/sec, averaged over gap $\epsilon$. The volume V of air displaced during one piston stroke is then: $V=[(va).\pi(D/3).\epsilon]/20$; because one piston stroke takes place in 1/20 second and the shaft diameter is $\sim D/3$. Thus the air energy expended through gap $\epsilon$ is: $2P_2.400.\epsilon\pi(D/3)/20$. The energy required to drive the air compressor is (1/0.8) times that. The reader familiar with the art will understand that the above unorthodox shortcuts made above are for the benefit of less sophisticated readers, it represents only a quick and rough way to obtain answers which, though very approximate, are meaningful enough in the present disclosure context.

Thus, the energy produced per piston stroke is: $0.3(\pi/4)D^2.S.P_2$, and the energy "lost" per piston stroke to compress the high pressure air is: $[800\times\epsilon\times P_2\times\rho D/60]/0.8.S$ must be expressed in feet whilst D and $\epsilon$ are expressed in inches, for proper correspondance of associated dimensions. The ratio of these two energies is representative of the penalty imposed by the piston air journals. The energy ratio is then: $[800\times\epsilon.\pi D.P_2/60]/0.8[0.3\pi D^2.S.P_2/4]$. With the correct units $S=1$, $D=5$ and $\epsilon=0.01.P_2$ and $\pi$ are eliminated. The meaningful parameters left are D, $\epsilon$, S and indirectly either vp or the piston cycling frequency. Replacing D, and S by their values yields about 4.4% for this energy ratio. Thus, it may safely be assumed that the loss in engine overall efficiency caused by the use of air journals is less than 5% if a central piston guiding shaft is used, neglecting any provision for thermal differential expansion. This matter must now be discussed in more details to ascertain such assumption validity.

Free-piston Combustor Construction Materials

Regardless of how rough the estimate made above is, one can safely and accurately states that the nominal efficiency penalty quoted increases proportionally with $\epsilon$. Although the number quoted is more than acceptable in view of the advantages which this construction yields, it becomes questionable if $\epsilon$ must reach values three times larger in order to fully eliminate the influence of the thermal expansion differences which occur with most metals commonly used in IC piston engines, assuming temperature differences of a few hundred degrees fahrenheit. A case in point, if both piston and sleeve were made of cast iron with a mean thermal expansion coefficient of $6\times10^{-6}/°-F.$, the piston OD above and a temperature difference of 400°− F. in an extreme case—hot piston and cool sleeve, the radial differential expansion would be roughly 0.0036 inch. It would be 0.0012 inch between shaft and piston. The total amount of play which the air gap must provide thus doubles, using the conventions earlier defined.

However, composites of graphite/carbon-reinforced exhibiting only half of such expansion would require an increase of only half that. Then, because the sleeve could operate at higher temperatures and could thus be thermally insulated, the temperature difference could be cut by 2. The amount of maximum thermal differential expansion is cut by a factor of 2 again. Finally, if ceramic composites having coefficients of expansion in the range of $0.01\times10^{-4}/°-F.$ ($\frac{1}{3}$ that of carbon-graphite) are employed and thermal insulation is used around the sleeve, the maximum amount of differential thermal expansion between the sleeve and the piston may realistically become negligible. Although the thermal expansion considerations above needed discussing first, other aspects of structural nature need be considered now.

Because friction between piston, shaft and sleeve can be eliminated altogether, lubrication is not needed. For this reason, all parts of the dynamic combustor may operate at high temperatures and the combustor may, and should, be thermally insulated externally so as to minimize heat losses. During normal operational conditions, no moving part of the combustor comes into physical contact with a fixed part. Mechanical shocks and wear are also eliminated. Such unusual operating conditions widen the range of applicability of new structural materials suitable for operation at high temperatures. These fall into two categories of materials:(1) densified graphite/carbon matrix materials reinforced with carbon/graphite fibers, and (2) certain types of ceramic materials. The best candidates for the present application can all be tailored to exhibit mechanical characteristics of interest in the constructions discussed: (1)low thermal conductivity and coefficients of expansion, (2) strength at elevated temperatures, (3) non-corroding, and (4) hardness. However, ceramics are not shock resistant and are brittle. They are also expensive, novel and not yet state-of-the-art, but gaining recognition fast. Some high temperature/low thermal expansion steels could also be used.

Carbonaceous reinforced materials are the best known and need no further elaboration. Both the sleeve and the piston could be made with such materials. The suitability of zirconium oxide—zirconia—is being investigated for applications in Diesel engine construction. Other ceramics of the carbide, oxide, nitride and/or boride varieties, of silicon, aluminum, etc. . . have enticing possibilities. Some can be developed to have truly negligible thermal expansion. The elimination of shock and friction in the present application overcomes the drawback of their inherent brittleness. Combinations of reinforced carbon/graphite parts with ceramic parts are possible here also. Thus, it can be said that differential thermal expansion between parts should not be of concern in the design and construction of the combustor.

Alternate Piston Support Construction

It was previously mentioned that the extent of the clearance needed between the sleeve and the piston in the case of a central shaft support could cause serious jetting of hot gases between the piston and the sleeve, in the case of a DAVID-I Cycle engine in which both gas peak temperatures and pressure differences across the piston are higher than those of a DAVID-II Cycle engine. In all free-piston combustor constructions incorporating air pad journals, two distinct piston guiding/supporting modes must be used: (1) one for imposing coordinated rotational and axial motions on the piston for operating the valving means, and (2) one for keeping the piston centered in its sleeve while these piston movements take place. Because only one circle of fixed size and location can pass by three non-aligned points located in one plane, the three contact points between the piston and the sleeve one point for each stub/groove asembly—theoretically could be used to center the piston. This is not practical for two reasons: the three points are in one plane which is free to wobble with respect to the sleeve axis and it is not practical to expect that such three points can be positioned (and be kept positioned) accurately enough. However, the sleeve inner cylindrical surface can serve as centering surface by proxy, by placing the air journal pads between the piston outer surface and that sleeve inner surface. This does crowd that interface which already provides the spaces for the valving means and the piston motion coordinating means, but it eliminates the need to provide for the tolerance stack-up otherwise required for concentricity sake, as discussed earlier. The risks of misaligned axes are also disposed of. The only tolerances left to handle are those on the piston OD and the sleeve ID which can easily be eliminated within ±0.001 inch by part matching, as previously mentioned.

FIGS. 1, 2, 6, 7 and 19 are used to describe such alternate embodiment of piston support with air cushion jpurnals. Two distinct approaches can be used for bringing high pressure air into the journal air pads: (1) through the sleeve walls, or (2) through the piston body. The features common to both approaches are described and discussed first. Because there are seven areas extending the length of the piston in which the three guiding grooves and the four port-travelled regions inside which a port may be located at any time, it is logical to situate the air journals between these seven areas within the seven intervals therebetween, two pads in each interval space, or fourteen pads total arranged in seven sets of two pads each. Each pad 65 of FIG. 7 is divided into two separate half-pads along symmetry line $\sigma$. Each half-pad air space at pressure Pi is isolated from the other by a land similar to land 68. An air collection groove such as 71, and connected thereto, surrounds each half pad.The high pressure air flow into each half-pad air journal is controlled by a restricting orifice which plays the feedback role explained earlier. In this embodiment, fourteen air pads are then distributed almost evenly around the piston circumference and length, in two opposing goups, each air cushion providing its radially directed reactive force that increases when the air pad land gap between the piston outer surface and the sleeve inner surface widens, and vice versa.In this air journal construction, the air journal pads provide both piston centering and alignment relatively to the internal cylindrical surface of the sleeve. The full length of the piston can be utilized to that effect. In this embodiment, neglecting thermal differential expansion, the total amount of radial clearance between the piston and the sleeve can be as low as 0.004 to inch. If the piston were allowed to contact the sleeve along one generatrix line, the total width of an air pad land gap diametrically opposed would only be 0.008 to inch. Because of the air gap control exerted by the restricting-orifice/air-gap cooperation, this is practically limited to 0.006 to 0.007 inch. This amount is almost only half of the value anticipated for a central shaft support and could be considered adequate for a DAVID-I Cycle EC engine. The narrowness of such a gap presents a much improved barrier against hot combusted gas jetting.

The supply of high pressure air to the journal pads may now be described and discussed. The supplying means could be located on either sides of each air pad, piston side or sleeve wall side. Each approach offers advantages and disadvantages. The simplest consists in ducting high pressure air through a feed hole such as 70 of FIG. 7, but located in the sleeve wall and connected to the high pressure air supply. Restricting orifice 72 is located in that hole. One inconvenience is that one feed hole cannot supply two half-pads of one set, the lands and the groove located between two half-pads of one set would interrupt that air supply during half of the piston stroke. The solution is to revert to 7 full length pads and a much smaller "torque" air pad at each end thereof and supplied with air at pressure $P_i$ as was earlier described. The main air pads must also have a width at their middle location equal to or larger than the feed hole diameter plus $\lambda$ of FIG. 6. The net disadvantages are: (1) a larger circumferential length required for the piston—larger OD, and (2) higher pressure $P_i$—as earlier discussed for the "torque" pad air supply. These may be minimal, but a second approach merits a discussion.

If the central hollow shaft 100 of FIG. 2 is given a smaller diameter and still traverses the piston, it can be used as a channelling means for the high pressure air but not for supporting the piston. The partial section shown in FIG. 19 depicts this construction embodiment. Piston 20' a central bore 300 that surrounds tube 100' and is shown end of its stroke which occurs when the lip of sliding seal 301 reaches phantom line x. A plurality of holes 302 located at mid-point between the tube ends vent tube 100' inner space into annular space 303 located between the tube surface and bore 300 surface. Air at high pressure is supplied inside tube 100' in the manner previously described for shaft 100. Seals 301, one at each end of bore 300, enclose volume 303 filled with air at pressure $P_1$. Seal 301 is retained in piston 20' by means of its rigid annular structure 304 positioned in groove 305 formed by circular flange 306. The lip of seal 301 consists of thin springy foils concentrically and circularly wrapped around tube 100' outer surface.

A plurality of slots 307 cut part way into the foils are arranged so as to alternate in locations from one foil to the next. These slots thus offer no passage to the high pressure air and form a sealing barrier extensible and flexible so that piston 20' is not radially constrained. The clearance between the tube OD and flange 306 ID is much larger than the clearance between the piston OD and the sleeve ID. The only friction generated is caused by the sliding of seal 301 on tube 100'. The distance between the end edges of the sealing lips is only slightly larger than the sum of the piston stroke S and of the diameter of a hole 302. It should be emphasized that holes 302 neither contain nor play the role of a restricting orifice.

Ducts 308 located in piston 20' structure or tubes 309 mounted thereto connect pressurized to their respective "half-pads" located on the piston outer surface. These pads thus can be given any suitable and advantageous contours compatible with those contours previously identified in FIG. 6 which outline forbidden penetration zones. The circumferential length requirement imposed on the piston is lessened and no "torque" pads are then needed. The only disadvantage is that a minimal amount of friction is introduced. The nature and extent of this minimal penalty are worth discussing now.

The external surface of tube 100' can be well polished and is enabled to remain so since no physical contact is ever made between that surface and any other hard surface. It is not exposed to direct impingement of compressed air and seal 301 is its only physical contact. The construction of that seal is crucial and of most importance. A prefered construction is based on the use of densified graphite reinforced with high strength carbon fibers. These fibers are laid flat on the bias so as to form a thin foil consisting of a few criss-crossing fiber layers. These fibers are caused to penetrate in seal structure 304 so as to become firmly locked by the structure. Several stacked layers of foils are thus locked in place but free to bend on account of slots 307 and because adjacent foils are not bonded to each other and are free to slide with respect to one another. The fibers in each foil are embedded in a high strength densified graphite matrix. The seal assembly thus forms a short flexible truncated conical structure emerging from the solid ring of structure 304. The ID of the truncated cone free edge formed by the ends of the flexible thin curved blades thus created is slightly smaller than tube 100' so as to ascertain that contact with the tube and the seal lip is always made, even when space 303 is not pressurized. Pressurizing that space increases the degree of pressure exerted against tube 100' surface used as sliding track.

Graphite has and anti-seizing qualities which insure that the amount of friction is low and that tube 100' sliding surface remains polished. Such a seal cannot be rendered absolutely airtight. A negligible amount of air will always find its way along slots 304 and between the foils. However, the sum total of the effective areas of such air passages can be made very much smaller than the sum of the areas of the control restricting orifices located in ducts 309 or tubes 308, between the air pads and space 303. The small air leak resulting therefrom can be ignored for all practical purposes.

A possible disadvantage is the wear which could be inflicted on the seal lip sliding back and forth along tube 100'. Care may be taken to alleviate this problem. This can be done by causing the fibers embedded in the flexible foil blades to contact the tube surface with their free ends almost tangentially so as to minimize any damage to the graphite matrix material and have the fiber tips supported by and pressing flat onto the tube wall. The material of the tube wall should be so hard that the wall surface retains its original polish during the life of the engine and can resist abrasion from the tough carbon fibers.

Another seal construction uses metal alloys instead of carbonaceous materials. The shape and design of the seal are identical to those already described above. In both cases, ceramics can be used for the tube material, though high temperature steel alloys would also qualify. To minimize the influence of thermal differential expansion between the sleeve and the tube, thermal stresses and/or deformations resulting therefrom, one end of the tube may be mounted onto the corresponding sleeve end closure by means of a slip joint. The gap between flange 306 ID and tube 100' OD could be 0.025 to 0.030 inch to guarantee complete piston radial freedom, while providing adequate support to seal structure 304. The latter is held tightly in place in groove 305.

It is impossible at this juncture to ascertain which one of the two construction approaches to the alternate piston support embodiment is most advantageous. Only prolongued tests of both approaches can provide the comparative results necessary for a meaningful evaluation. The engine efficiency loss caused by the high pressure air servo-flow could however be half, or even less, of that previously estimated for central shaft supporting of the piston. Also, because the maximum of the peak pressures reached by the combusted gases depends on the engine mode of operation—i.e. DAVID I Cycle versus DAVID II Cycle—it might prove that one approach to piston support is more suitable than the other.

Control of Free-Piston External Combustion Engines

The general aspects of the control of such engines are extensively described and discussed in my U.S. Patent CIP Application Ser. No. 789,451 dated 10-21-'85. The details and derivations of the equations used in the control logic and/or program are not repeated herein, as the reader familiar with the art will recognize the validity of the final algorithm results used herein. The control approach preferred and adopted herein is first discussed.

The most generalized usage of engines in the range of 30 to 300 HP's pertains to automobile propulsion, and of most large motorcycles. The vehicle is operated in an almost standard manner in all instances: the vehicle operator adjusts the engine power output so as to attain and maintain a desired vehicle speed and/or to comply with limits imposed on him (her) by traffic conditions, be they of a velocity or acceleration nature. The operator thus completes the vehicle power control loop, acting as the feedback signal sensor and processor, and response actuator.

During all of this control process involving operator and machine, the operator may have a feel for the power level needed of and delivered by the engine, but has no exact knowledge of it; in the majority of cases, not even any appreciation of it. In most expensive and/or sporty vehicles, an indication of the engine rotational speed (rpm) may be provided. The use of automatic transmissions even negates the usefulness of such information. In a general rule, the operator adjusts the fuel flow delivery to the engine either indirectly (gasoline engines) or directly (Diesel engines). The respective advantages and/or disadvantages of either engine control types are well known and need no further elaboration here. Suffices it to mention that the ratio of air flow to fuel flow is not satisfactorily monitored, though efforts are now being made to remedy this situation, especially with gasoline injection, which is most critical during transient and transitory engine operation periods: i.e. accelerations and decelerations. In the case of the engine of the present invention, two engine construction and operating factors are basically very different from those of IC engines:(1) mechanical decoupling of the motoring function embodiment from that of the fuel burning function, and (2) the consequence thereof that the fuel combustion process can be given many times longer to be completed. Steps of measuring and metering are given more time to be performed and the amounts measured and metered are much larger on a unit basis.

The easing of the usual time constraints imposed on control systems of IC engines offers a unique opportunity to the EC engine designer, that of being able to concomitantly monitor the flows of fuel and air, and timing thereof, especially during transitory operating periods, so as to influence or control incidental results of the combustion process: e.g. pollutant production. Although incidental and considered so years ago, the production of pollutants in the engine exhaust has now become a major and significant aspect of the engine operation and control. This subject should be addressed first now.

Given the highly exothermic nature of the chemical reaction between hydrocarbon types of fuels and oxygen, given enough time and an excess of oxygen, with the right temperature conditions, all of the fuel can burn. Two conditions are now identifiable as necessary for full combustion: (1) excess of oxygen, and (2) temperatures. It is well known that temperature alone can initiate fuel selfignition (Diesel), thus it has a beneficial effect. However, as is so often the case in life, too much could be harmful. This applies here because the oxygen is necessarily mixed with nitrogen in air that constitutes the oxygen source. At combustion temperatures resulting from the combustion of most common hydrocarbon fuels at stoichiometric ratio in the compressed air of IC engines, oxygen also reacts with nitrogen, although somewhat endothermically, and various forms of nitrous oxides result. The mixture of these forms of nitrous oxides are referred to in the automobile pollution field as $NO_x$. All excess oxygen or for that matter not in excess sometimes, does not contribute to the formation of this polluting agent. However, when released in the atmosphere with the exhaust gases it has well known noxious interfering reactions on life forms on earth. Its production rate is thus to be minimized in any improved engines.

In OTTO Cycle IC engines, both peak pressures and temperatures reached at the end of the combustion phase are higher than those reached in Diesel engines, in which excess air is always present. For that reason, neither $NO_x$ nor volatile fractions of unburned fuel are present in the exhaust gases of Diesel engines, except for carbon soot which creates another cause of particulate pollution. The latter condition manifests itself particularly during period of acceleration when excess fuel is poured in the engine to increase torque momentarily. Obvious conclusions must be drawn from thereabove: (1) during steady operating conditions of the engine, peak temperatures should remain below a certain critical level, and (2) during engine accelerating periods, no excess fuel should be introduced in the combustion chambers; if full advantage of the present novel engine is to be taken.

For this reason, it is considered mandatory that the present EC engine control system determine and insure that the fuel/air ratios remain within established limits at all times. Such limits and the intermediate steady-state power-level value of said ratios are presented in the graphic representation given in FIG. 38 of the application previously cited (Ser. No. 789,451). They may be analytically expressed as $$W_f/W_a = r_f = k.p \tag{6}$$

where the various parameters therein are as follows: $W_f$=Fuel amount per piston cycle; $W_a$=Air amount available to burn $W_f$ and present in the combustion chamber; $r_f$ selfdefined in equation (6); k is the slope of the straight line in FIG. 38 graph; and p represents the variable percentage of full power $\tau_{max}$ which an operator selects to obtain the engine power level desired.

During transient conditions (transitory engine regimes) corresponding to either acceleration or deceleration periods, $r_f$ is automatically maintained at either a constant value (r') higher or a constant value (r'') lower respectively than the value given by graph line of FIG. 38 at any and for all settings p of power between idling (I) and $\tau_{max}$. r' and r'' need not be exactly constant as p changes and can be caused to vary as a function of p in an optimum fashion that may take into consideration peak temperature limits, smoother engine running at idling and/or better fuel combustion and/or ignition at combinations of low engine regimes and lean fuel/air mixtures. For ease of representation, it is to be assumed that:

$$r' = r_{max} + k'(p-1) \tag{7}$$

and $$r'' = r_{min} - k''.p \tag{8}$$

k' and k'' are constants, $r_{max}$ and $r_{min}$ represent those values which r might theoretically reach at maximum power and idling speed respectively, they represent only adjustment setting constants. Thus, according to these premises, the amount of fuel that may be introduced in either combustion chamber during any piston cycle is perfectly and singularly determined as a function of $W_a$ at any and all times and under any and all engine operating conditions. $W_a$ cannot simply be measured, it is calculated by a central processing unit (CPU) which includes a preprogrammed computer that performs the computations required, using the equations indicated above in addition to those derived below.

The power setting p (0 for idle and 1 for full power) as adjusted by the operator establishes the degree of opening of the air intake valve, i.e. its effective area A. The combination of A, the air conditions (pressure and temperature) upstream of area A, the pressure downstream of area A and a time duration are the necessary and sufficient parameters needed to compute $W_a$ in terms of air weight admitted in either combustion chamber. Generally, the rate at which air weight flow passes through an orifice can be expressed by either of these two equations:

$$\dot{W}_a = K' \cdot A \cdot P_2 \cdot [(1/T_1)(P_1/P_2)^{0.283} \times \{(P_1/P_2)^{0.283} - 1\}] \tag{9}$$

or $$\dot{W}_a = K'' \cdot A \cdot P_1 \cdot T_1^{-\frac{1}{2}}, \tag{10}$$

if $P_2/P_1 \leqq 0.53$ for dry air. Equation (9) applies if $P_2/P_1 \geqq 0.53$ (subsonic condition at A), whereas equation (10) applies when sonic velocity is reached by the air flowing through area A. Such a condition could develop when p (and thus A) is reduced abruptly from a high value to a low value which could happen if an emergency stop is needed at full vehicle speed, but would last only momentarily, during the period needed by the piston to slow down, which should take no more than two or three cycles.

The air weight flow $W_a$ through, A in a given period of time is then $$W_a = \int_o^{\Delta t} \dot{W}_a \cdot dt \tag{11}$$

where $\dot{W}_a$ is a function of time and is given by either equation (9) or (10), depending on the value of $P_2/P_1$. Depending upon the value p of the power demanded by the operator and set by him (her), equation (6) determines the amount of fuel by weight which must be delivered:

$$W_f = W_a.k.p \tag{12}$$

in the combustion chamber in which $W_a$ was just introduced. The fuel is burned and energy is delivered in form of combusted gas at a combination of pressure and temperature which determine the amount of energy produced during that piston cycle. As time passes and cycles succeed one another, a set level of power is delivered by the engine. Depending on whether or not this action produces the result expected by the operator, the operator may or may not further alter the setting of p. Regardless, the process continues, though a digression is justified at this juncture.

From a steady-state engine operating point, an adjustment of p causes the following sequence of events to take place. First, the free piston must adjust its cycling frequency; second, the flow rate of combusted gas changes; third, the combusted gas pressure in the storage tank also changes; four, the average effective pressure of the gas expanded in the expansion chamber changes accordingly; five, the shaft power available externally changes; six, the amount of propelling energy transferred to the vehicle varies; seven, notice is taken by the operator of the latter change or adjustment; and eight, the change may or may not satisfy the operator, at which time the operator may or may not seek a further adjustment of p. The process described above is not very different from that which happens everyday when driving a car, at first glance. At second glance, one difference exists: the time lag between the change in combusted gas pressure in the combustion chambers and that which manifests itself as adjusted effective pressure in the expansion chamber. This time lag is created by the need to add or substract a finite amount of combusted gas to or from the storage tank contents. In principle this could result in a sluggishness in the engine response.

The important factor involved here is time. If the volume of the storage tank were large,i.e. several times the volume of one combustion chamber, the engine response would indeed be sluggish. However, if the volume of the combusted gas portion of the storage tank is about the volume of a combustion chamber, the amount of combusted gas needed for making up for the finite amount to be added or substracted can be produced in the combustor during one or two free piston cycles. The free piston frequency varies probably between a few cycles per second (cps) to a few hundreds. Therefore, even at low engine regimes, the response lag could vary between a few tenths of a second and a few hundredths of a second. The latter number is too small for the operator to even notice. The former number could be noticeable by a driver used to fast responses to gas pedal actions. The heat exchange efficiency of the storage tank is related to the length of residence time of the combusted gas therein. This consideration points to an advantage in larger storage tanks. It is impossible to establish at the present time which compromise represents the best design trade-off. Therefore, it is assumed that the control system is capable somewhat of "making up" for the sluggishness deficiency.

This can best be achieved with the use of a lead signal between the operator's power control lever position (p* demand) and the corresponding value of the pr signal sent to and received by the CPU. The amount of lead can be made a function of the rapidity with which the operator executed the demand for variation Δp of p, then in force immediately prior to the demand initiation. This can be performed preferably electronically by means well known in the art and in a manner such that pr becomes temporarily a function of time (t), a follows:

$$p_r = p_o + \Delta p[1 + h.(\Delta p/\Delta t_a)\exp(-t/H)] \quad (13)$$

where $p_o$ is the value of p at the time the p change is initiated, $p^* = p_o + \Delta p$, $\Delta t_a$ is the time taken by the operator to complete the Δp change, h is a constant greater than 1, H is another constant that determines the rate of decay of $p_r$ down to p* as a function of time and with h define the degree of lead provided and t is real time. The lead function generates the equivalent of an overshoot, common in servomechanism responses.The ratio $\Delta p/\Delta t_a$ is a correction factor that represents the degree of swiftness of the command. It does not seem that the equivalent of an undershooting lead function is needed. The reader will easily see how an equation derived along the same lines as equation (13) could be used, if deemed necessary. The electronic construction needed for generating the lead function of equation (13) is state-of-the-art. Such simple circuit construction is inserted between the p input sent by the operator and the p-input received by the CPU.

At the beginning of an engine acceleration phase, except if p* demanded by the operator is 100%, the peak value of $p_r$ signal received by the CPU thus increases the opening amount of the air intake valve as compared to what it would have been were it not for the lead function generator. More compressed air is admitted in the combustion chambers than they would otherwise have received, more combusted gas is produced than would otherwise have also been the case and this excess provides the additional combusted gas amount needed on account of the storage tank.The exponential decay curve of $p_r$ as a function of t is characterized by a time constant determined by H and equal to a few seconds. After several seconds, a new steady-state condition is reached by the engine control system, while the engine keeps accelerating, under the operating conditions set by the value p* selected by the operator.h can be made to vary as $$[1 + F.(p^* - p_o)] \quad (13)$$

where $1 \leqq F \leqq 2$ and F is rendered adjustable by the operator.

The amount of fuel $W_f$ computed from equation (11) and to be delivered in the combustion chamber receiving $W_a$ remains to be injected in that compressed air to mix and to ignite for combustion. Thus, three new parameters must now be considered: (1) the pressure at which the fuel must be injected to deliver $W_f$ in and at a given time, (2) the fuel injection initiation time, and (3) the duration of the fuel injection, assuming that the fuel is injected through a fixed size orifice or equivalent. The fuel flow rate through that orifice can be approximated as $C.(\Delta P)^{\frac{1}{2}}$ where ΔP is the pressure drop through the injector orifice having a discharge coefficient and effective area which combined with fuel density are expressed by a constant value C. If the variations of compressed air pressures in the combustion chambers are ignored as negligible (high fuel injection pressure), the amount of fuel injected can be written $$W_f = \dot{W}_f.\Delta t - C'.(P_f)^{\frac{1}{2}}.\ \Delta t \quad (15)$$

where Δt is the time during which pressure $P_f$ is applied and C' is an adjusted value of C which includes the influence of the compressed air pressure, as a first approximation. If a low pressure fuel injection is used, pressure $P_2$ can be taken into account and equation (15) becomes $$W_f = C.(P_f - P_2)^{\frac{1}{2}}.\Delta t \quad (16).$$

In both instances, the combination of $P_f$ and Δt determines the fuel amount injected per cycle. My Application Ser. No. 789,451 previously cited indicates how $P_f$ can be adjusted. The initiation of the fuel injection is timed automatically by the detected piston location. The determination of Δt now needs further elaboration regarding the type of thermodynamic cycle used.

A DAVID-I cycle and a DAVID-II cycle differ in the speed at which the combustion takes place: fast in a DAVID-I (OTTO-type) and much slower in a DAVID-II (Diesel-type). Thus, it might be that the fuel amount determination and injection should be different and ideally optimized for each DAVID-Cycle type. In order to enable the present invention engine to operate indifferently according to either cycle, provided that a check valve is located between the storage tank and a combustion chamber inlet valving port, provisions should be made in the control system to enable the operator to preferentially select the engine operating mode at any given time, depending upon the type of fuel which is available or preferred at that time. The control system must then be capable of operating optimally in each case. Because the amount of time available to inject the fuel is much smaller in a DAVID-I Cycle, the fuel control principle preferred is different enough from that which is preferred for a DAVID-II Cycle that each one deserves a separate and distinct discussion. However, it is assumed that the determination of the amount $W_f$ of fuel is carried as was just described, its temporal delivery only differing.

In a DAVID-II Cycle engine, fuel is injected and burns at rates such that the combusted gas pressure $P_2$ resulting therefrom remains below the pressure level at which compressed air is being admitted in the combustion chambers. $\Delta t$ is comparatively long and may extend beyond the piston mid-stroke point. The check valve previously mentioned, if present (dual cycle capability), does not operate and remains continuously open except, if provided for in the control system, during periods of large accelerations. It is then practical and possible to calculate the weight of air in which fuel will be injected at least until the end of the first quarter of the piston stroke, although fuel injection may be initiated before that time, the duration thereof only varying as does the injection flow rate. In a DAVID-I Cycle engine, because an explosive combustion of the air/fuel mixture is desired, all of the amount of fuel $W_f$ is already present in the combustion chamber by the time the piston reaches the end of the first quarter of its stroke. The air/fuel mixture is ignited at the end of the fuel injection period and the fuel combustion is quick. The peak reached by pressure $P_2$ far exceeds the compressed air pressure and the check valve closes temporarily until $P_2$ reaches a value slightly lower than the compressed air pressure some time about the end of the third quarter of the piston stroke. From this brief description of events, the reader familiar with the art will visualize the basic differences existing between compressed air flows into a combustion chamber of a DAVID-I Cycle and a DAVID-II Cycle engine: highly pulsative in the first case and more regular in the second case. This basic difference in flow type renders the determination of air flow rates more difficult and less accurate for a DAVID-I engine than for a DAVID-II engine. Thus, relying entirely on equations (9), (10) and (11) to calculate $W_a$ after the piston has begun its stroke may not be the best sufficient means, especially in the case of a DAVID-I operation mode, for calculating $W_a$ and thus $W_f$. A pre-estimation of $W_a$ is warranted and can be applied to both modes of engine operation.

In addition, the means for adjusting the fuel injection pressure might not easily be made to respond fast enough to a quick adjustment of $P_f$. For that reason alone, the amount of air anticipated to be introduced during the next piston cycle in the adjacent combustion chamber is first approximated from piston data generated during the preceding cycle, as follows. During the second half of the third quarter of a piston stroke, the piston velocity is calculated from piston location data obtained from the piston location detector, effective as of the beginning of the fourth quarter of that stroke. It is compared to the corresponding velocity value that was obtained during the previous cycle. The piston corresponding velocity most likely to be reached during the next cycle is estimated as that which was just measured extrapolated and adjusted accordingly by the computed difference between the two last cycle corresponding velocities.

Based on experimental test data, a relationship is established for a given engine configuration operating in a given mode between this characteristic velocity and the amount of air that, under steady-state conditions, a combustion chamber will contain during a cycle. Such information is stored in the control system CPU memory for use during the life of the engine. This information is corrected according to the present conditions (pressure and temperature) existing in the storage tank compressed air and then used for each piston cycle in combination with the piston velocity just calculated. A value $W_a^*$ the estimated amount of air weight available during the next piston cycle is calculated. A corresponding value $W_f^*$ is also calculated. The fuel injection pressure and the duration to be used for such value are then predetermined so that the pressure $P_f^*$ and the time $\Delta t_f^*$ may be both adjusted accordingly. $P_f^*$ being the most critical parameter to readjust quickly is kept at its pre-adjusted value in the case of a DAVID-I Cycle engine and $\Delta t_f^*$ value is readjusted to make up for any discrepancy between $W_a^*$ and the value $W_a$ computed using equations (9), (10) and (11), at the beginning of the subject piston cycle. In the case of a DAVID-II Cycle operation, both fuel injection pressure and duration may be corrected and readjusted, much more time being available therefor.

Time, as mentioned above, refers to a percentage of the duration of a cycle. As compared to real time, these two times differ in the same ratio as do the piston cycling frequencies and its characteristic velocities, between idling and full power speeds. The response time of mechanisms not coupled to the piston motion is independent of the engine regime. Thus, at low piston frequencies, especially in the case of the DAVID-II Cycle operation, the use of data generated during the preceding piston cycle may be unjustified, whereas it is most likely always needed in the case of a DAVID-I Cycle operation mode. A simple logic-loop routine can be included in the CPU computer program which determines if and when the pre-adjustment routine should be applied, as a function of p and/or piston velocity, so as to unburden the CPU operation. Such sub-routines are commonly used in computer programming and are well known by the readers familiar with the art.

The timings of the initiation of the fuel injection and of the activation of spark plugs also require different treatments, depending upon the mode of engine operation. In a DAVID-I Cycle mode, fuel injection should start as soon as the piston has begun its stroke on the correct side of its guiding grooves. The full amount $W_f$ should be injected before ignition is activated. As a matter of fact, a very short lag could be beneficial as it would allow a more homogeneous mixture of air and fuel to form. In a DAVID-II Cycle mode, fuel should start burning as soon as it comes in contact with the compressed air, or soon thereafter. If not, delayed ignition of the fuel could result in a scaled down version of the DAVID-I Cycle mode, which is undesirable under normal steady-state operating conditions. Thus, ignition must be activated almost concurrently with the onset of the fuel injection or soon thereafter. These differences are numerically examplified in Table A entittled CYCLE COMPARISON CHART, although the timing "degrees" indicated therein are only given as an approximation.

The locations at which various signals are generated by the piston-location detector are indicated in FIG. 6 by a point on at least one of the three groove-tracks that the stubs installed on the piston follow. The positions of these points are shown for indication purpose only and can be moved to accommodate a specific combustor construction and/or mode of operation. For instance, point ① corresponds to the first timing signal generated by the piston at the beginning of its stroke. The elongated raised ramp (or raised shaped bump) located at the bottom of the guiding grooves (see FIG. 4 for reference), identified as F, comes immediately after, point ao1 indicating both the beginning of that ramp and the time at which the air inlet port starts opening. The length of the ramp is used as the element of distance for calculating the average piston velocity at the beginning of its stroke, as it is divided by the time elapsed between the signals generated at both ends of the ramp. From the discussion above, it is evident that the relative positions of these points and the ramp length should be ideally different between DAVID-I Cycle and DAVID-II Cycle engines. This could, and might unless otherwise provided for, preclude the dual use discussed above.

Obviously, point ① could have the same location in both cases. Points such as ao1 indicate the piston position for which the air inlets "crack" open, this is the result of the relative locations and sizes of the sleeve port 31 and the corresponding piston port 37, such fixed construction features are not adjustable to accommodate an operation mode change in a given engine. However, the requirements of the DAVID-I case of an earlier air admission starting point are compatible with the corresponding requirements of a DAVID-II case. The effective closing of the air inlet ports is performed by a $P_2$-responsive check valve in a DAVID-I case and as such is compatible with the requirement of longer-lasting opening of a DAVID-II case. This point deserves a short digression regarding a curious operating opportunity presented by the dynamic free-piston combustor of the present invention and worth noting.

If and when the fixed closing of the air inlet ports is late enough and the amount of fuel injected is lower than normal, i.e. during fast decelerations, because of the piston velocity, $P_2$ may become lower than the inlet compressed air. The check valve will then open and let compressed air in the combustion chamber which will then mix with the combusted gas therein. The possibility of constructing and operating a DAVID-I Cycle engine in such manner under normal steady-state operating conditions is appealing for two reasons: (1) the equivalent of a lean "OTTO Cycle IC-engine" overall combustion can be realized whilst the combustion process really occurs at an ideal stoichiometric ratio, and (2) the equivalent of a cooler combustion is achieved with the use of excess air instead of excess fuel whilst again benefiting from a stoichiometric combustion process. Such an operation mode results in an hybridization thermodynamically between DAVID-I and DAVID-II Cycles. A more elaborate discussion of the merits and faults of such hybrid Cycle, and advantages thereof, if any, and of its optimization is beyond the scope of this disclosure. It is assumed in the following that under steady-state engine conditions, such an eventuality does not materialize, unless by design.

The lengths of ramps F, G, and H were described as being the same for all three ramps. However, each ramp could have a different length, and for that matter, a different starting point ao1. Each ramp could then be used for a specific Cycle mode: DAVID-I, DAVID-II and hybrid, and be built in each engine. Therefore, the selection of ramp to be used for its signal generating could be made concurrently with the selection of the engine operation cycle mode. A three-position switch located between the CPU input ports and the computer, and coordinated with the selection switch in the computer used for selecting the computer program which corresponds to the operation mode chosen by the operator, could easily set up the operation mode selected with one adjustment by the operator of one 3-position switch on the vehicle dashboard (identified as D-I, D-II and H for instance).

Depending upon the Cycle mode selected, the signal for activating the ignition must be generated as follows: (1) at the end of the fuel injection for a DAVID-I Cycle or after a short time delay which can be made adjustable by the operator and/or automatically,; and (2) at the starting time of the fuel injection or after a short time delay which can also be made adjustable automatically and/or by the operator in the case of a DAVID-II Cycle. Ignition timing is then directly connected to the fuel injection which of course is controlled and monitored by the CPU, the beginning (DAVID-II) or the end (DAVID-I) of $\Delta t_f$. It is thus simple internally to the CPU computer to electronically establish such connection by means well known in the art. The automatically adjustable time delays mentioned are made dependent upon two major factors influencing combustion: (1) the flammability characteristics of the fuel, and (2) the piston average velocity per cycle or its cycle frequency. The fuel characteristics adjustment is external to the CPU and done manually by the operator. The adjustment based on the combustor regime is done internally by the computer.

My application Ser. No. 789,451 discusses the relationship between $W_f$, $P_f$, $\Delta t_f$ and the piston frequency. This is not repeated here. Suffices it to indicate that at idling speed the amount of real time is maybe 10 times larger than what it is at full engine power rating for the same piston travel increment. This is taken into account by adjusting both $P_f$ and the injector orifice size accordingly by means well known in the art of fuel injection. No further elaboration is needed here. In any event, the real time at which the ignition can be activated is established by the computer program so as to enable the CPU to generate and to send an activation signal to the ignition energizing system, as is well known in the art.

Between a point such as va of FIG. 6 and point ac1, by design the compressed air inlet valving ports close. It is indicated as being between 90 and 110 "degrees" in TABLE A and arbitrary but fixed, and shown in FIG. 6 as being between more than 90° and less than 110°. At this juncture, only extensive experimental data could help the designer define more exactly the optimum positioning of point ac1 for each Cycle mode of operation or for dual/triple modes of operation. In any case, somewhere between points va and ac1 of FIG. 6, ramps are located on the bottom of the piston guiding grooves for detecting the piston position and thus calculating the average velocity between two of such ramps. If located at a distance $\Delta S$ axially and if a time $\Delta\tau$ is measured by the computer real time clock between the arrival of the two ramp signals, the piston average velocity during the third quarter of its stroke is approximated as $\Delta S/\Delta\tau$. This mean piston velocity is used as indicated elsewhere herein and for calculating both the piston instantaneous frequency—during the subject cycle and the two cycles immediately before and after—and the amount of shock absorbing capability with which the piston must be provided at the end of that cycle for adequate rebouncing as earlier mentioned. Again, the reader is reminded that one piston cycle corresponds to one piston stroke and 180° in TABLE A.

The opening of the combusted gas outlet valving ports is automatic and fixed by design. It happens before the closing of similar outlet ports provided for the opposite combustion chamber, so as to insure a continuous non-pulsating supply of combusted gas into the storage tank. In TABLE A the minimum "angular" delay between the closing of the compressed air inlet ports and the opening of the combusted gas outlet ports is indicated as 45°. It can probably be much less, 20° to 25°, and still provide an adequate isolating sealing effect between air and gas, especially because their pressures are not that much different by then, even in the case of a DAVID-I Cycle operation mode. About half-way between point ac1 and the piston stroke end, the combusted gas outlet ports of the opposite combustion chamber close. The timing of this closing needs only insure that the correct amount of combusted gas becomes trapped between the piston end face and its corresponding sleeve end closure, so as to ascertain an adequate piston rebouncing past the stroke end point e1. This was discussed earlier. The optimum "angular" location at which the closing of the combusted gas outlet port of the opposite combustion chamber occurs is fixed and defined by a corresponding ramp location on the bottom of the guiding grooves. It is determined experimentally for a given combustor construction and operating regime. The signal generated thereby can be processed in the CPU computer for adjusting the pressure setting of the piston shock absorbing system, as the timing of this signal in conjunction with those of the signals generated for calculating the piston average velocity may help further define the amount of piston kinetic energy that the shock absorber will have to handle.

No other location and/or timing signals are needed from the piston until it reaches the end of that cycle, point e1. That location corresponds also to the starting point of the following cycle (second 180° part in TABLE A) which ends at point So which was the starting point of the cycle just discussed. The same control process of fuel injection and ignition, and of piston location and velocity monitoring is repeated. The information received by the CPU and processed by its computer and needed for calculations during the next cycle, is stored for future retrieval and use as was previously described and discussed. At the end of each cycle, the duration $\tau$ of that cycle is measured and also stored. The average axial velocity of the piston during that cycle is also calculated as $S/\tau$ and stored. The frequency of the piston alternative axial motion $\phi$ is also calculated as $1/\tau$ and stored. Note that the frequency is based on a piston cycle being "180°".

As was previously mentioned, the process is allowed to continue uninterrupted provided that the piston passes through points So (or e1 as applicable) so that the next cycle takes place along the correct branch (or side) of the quasi elliptically-shaped track. It is possible to determine whether the piston is rotating in the correct direction at either one of these two points with the use of an asymmetrically-shaped ramp, although the piston has no axial speed then (null point). When reaching that null point, the piston is first detected by the ramp leading edge, then its passing is immediately checked by either one of three events: (1) another reverse signal from the ramp edge just passed, (2) a signal from the ramp trailing edge, or unlikely (3) the pressure rise caused by the piston guiding stub does not fall off—the piston has stopped at the null point. The CPU computer has a logic subroutine which decides that a mispass (piston rebouncing) has occurred, if event (1) or (3) takes place. As earlier described, a piston start-cycle is then initiated by the computer program and a new starting cycle begins. The case of event (2) of course corresponds to a normal operation of the free piston.

To summarize, the engine control is accomplished automatically, be it during steady-state or transient conditions according to the operator's input which takes two forms: (1) continuous monitoring of the engine power by means of a power lever (or pedal) connected to the CPU, where the power lever position defines a percentage p of full power, and (2) manual adjustment of dials or selection knobs, done only occasionally. Table B below indicates those adjustments and/or selections that the operator makes.

TABLE B

| OPERATOR's INPUT | |
|---|---|
| Selections | Adjustments |
| Cycle Mode of Operation | Fuel Characteristics |
| Nature of the Fuel Used | Acceleration Lead Time |
| | Fuel Ignition Advance or Delay |

Although well defined relationships generally exist between the fuel nature and its characteristics, because of the wider range of liquid fuel types which the EC engine of the present invention can burn, the availability of finer fuel adjustments in addition to fuel type selection by the operator may prove very beneficial. Flammability was mentioned earlier as an example of a typical characteristic which is of great importance in the case of a DAVID-I Cycle operation mode.

The continuous monitoring by means of p adjustment is performed by the control system. The CPU computer incorporates the values specified by the selections and adjustments listed in Table B by means of knob or dial settings. The value of p given to the CPU by the power lever adjustment sets the air intake valve opening and the ratio to be maintained between air and fuel weights during each piston cycle. Using measured air data and air intake valve opening area, and programmed instructions, the CPU computer calculates the amount of fuel to be injected during each piston cycle. This fuel amount is metered by means of the injector nozzle area, the injection pressure and the duration of the injection. The injector nozzle area is variable in function of the injection pressure as is well known in the art and the combination of pressure and time establishes the amount of fuel injected. At this juncture, the cases of DAVID-I and DAVID-II Cycle operations must be treated separately.

In a DAVID-I Cycle (and Hybrid) operation, a predetermination is first made during the preceding piston cycle of the weight of air that will most likely be admitted in the combustion chamber during the next cycle, using piston velocity data obtained during that very piston cycle. The corresponding fuel weight is also predetermined. Prior to the piston reaching the end of the preceding piston cycle, fuel injection pressure and duration are accordingly also predetermined, as earlier discussed. When the piston begins its next stroke, the measured time elapsed between the passing of the null point and the reaching of the first piston location detection ramp is processed by the computer to determine the amount of air which will be introduced in the combustion chamber during this piston cycle. The fuel injection duration already predetermined is recalculated to match the new value, if any, of air weight which will be admitted, according to the new estimation. The predetermined injection pressure which has in the meantime been adjusted is fixed, but the duration of the fuel injection is adjusted from the predetermined value to a new value which will, in conjunction with the predetermined fuel injection pressure, insure the delivery of the new recalculated fuel amount.

The computer then calculates the time at which fuel injection will stop. Based on values given by the operator's adjustments to adjustable constants in the computer programmed instructions, the time at which the ignition is to be activated is calculated. A signal for the activation of the ignition system is generated by the CPU and sent thereto after fuel injection has stopped. At that time fuel combustion occurs "explosively". Depending on the values of adjustable constants in the computer program, the time lead or lag between the end of fuel injection and ignition activation is adjusted as a function of fuel characteristics and piston speed. This timing adjustment is made to insure the optimum fuel combustion process. It should be remembered that, until combustion occurs, compressed air is being admitted in that combustion chamber until the explosive combustion overpressure wave urges the check valve to close. Compressed air introduction ceases, although the compressed air inlet ports may still be registered in an open position. The distinction in cycle operation between a pure DAVID-I Cycle and a Hybrid Cycle manifests itself during the remnant of the piston stroke.

If the air inlet ports remain registered open during a major part of the piston cycle, the combusted gas expansion resulting from the piston displacement lowers the gas pressure in that combustion chamber below the compressed air pressure. The check valve opens and lets compressed air penetrate into the combustion chamber to mix with the combusted gas therein, until the inlet ports close. The piston completes its stroke. In this mode of operation, the mean pressure of the compressed air must be higher than the mean pressure of combusted gas produced. The duration of the compressed air admission per piston cycle is much shorter than the duration of the combusted gas exhaust out of the combustion chamber. Volumetrically under same pressure conditions, the amount of combusted gas produced is larger than the amount of compressed air used in that cyle, which incidentally is also the case in some instances of DAVID-II Cycle mode of operation. In a DAVID-I Cycle operation mode, such is not the case. At the end of the piston stroke, the combusted gas temperature and the pressure are comparatively higher. The mean pressure of the combusted gas produced may then be higher than the mean pressure of the compressed air. Volumetrically again, more combusted gas is exhausted than compressed air is admitted, albeit to a lesser extent. It is obvious that a DAVID-I Cycle mode engine operates at higher temperatures than a DAVID-II Cycle mode engine and especially a Hybrid type, as does an OTTO Cycle IC engine as compared to a Diesel Cycle IC engine, for the same reasons.

In a DAVID-II Cycle operation, fuel is injected more slowly than in a DAVID-I Cycle engine. There is generally no check valve to interfere with the compressed air flow into the combustion chamber as long as the inlet ports are registered open. As the piston moves away from its past null point, at the same time fuel is being injected, compressed air keeps being admitted. The parameters $P_f$ and $\Delta t_f$ characterizing the fuel injection are calculated and appropriate signals are generated by the CPU and received by the fuel system. The fuel injection proceeds for a duration $\Delta t_f$ from the start of the fuel injection and then stops. At the time the fuel injection started, the ignition system was energized by a signal received from the CPU. The time advance or delay calculated by the computer using the adjustments of the variable constants set by the operator determine the temporal sequence of the fuel injection initiation and ignition activation. Fuel is injected and burns at rates such that the compressed-air/combusted-gas mixture pressure remains below the compressed air inlet pressure. The piston average velocity over the length of ramp F is calculated in the manner earlier described and the duration $\Delta t_f$ is corrected so as to regulate the combustion rate. The combustor may be constructed in either one of these three manners: (1) the air inlet ports close early (90° or less), (2) the air inlet ports close late (120° or more), and (3) a check valve is used in conjunction with the manner (2). In the cases of manners (1) and (2), fuel may keep being injected after the flow of compressed air is stopped, while combustion may still proceed using the excess of oxygen still present in the combustion chamber. In which cases, the combusted gas pressure may, as is the case in a DAVID-I Cycle mode of operation, rise above the compressed air supply pressure.

The last paragraph discussion illustrates the flexibility of construction provided by a DAVID-II Cycle engine. The choice of construction of a valve-less combustor—i.e. positioning of the air inlet ports closing—and of its control is based on two engine application requirements: (1) the grade of fuel to be used, and (2) the level of the peak temperatures which is appears most desirable for the application. Further elaboration on this subject is beyond the scope of this disclosure. Suffices it to state that a combustor construction and operation mode can be optimized for pure DAVID-I, DAVID-II and Hybrid Cycles, and that both a DAVID-I and a DAVID-II Cycle combustors may be optimized for operation in a combination of modes which enables the engine to operate with a wider range of fuels, regardless of the nature of the motor part of the engine.

The combustor equipment accessories such as fuel injectors, spark plugs, fuel pumps, high pressure air compressor, pressure regulators, filters, spark plug energizing system, wirings and connections therebetween are neither described, shown nor discussed here as being well known, state-of-the-art and requiring no further mentioning. The connections between some of these accessories, the combustor and the motor are indicated in the schematic installation and arrangement diagram shown in FIG. 15. The reader familiar with the art will be able to recognize and identify such connections. The combination dump/by-pass three-way valve 300 is shown connected to ducts 157 and 158 by ducts 301 and 302, signal line 303 coming from the CPU and going to two exhaut ducts 304 and 305. All these are represented by dash-dot lines as they are somewhat incidental to the subject of this disclosure. Their functions and operations are fully described and discussed in application Ser. No. 789,451 and need not be repeated here. Also, dot-dash line 310 represents the high pressure air duct that supplies the air cushions provided in motor member 150, that is represented as a radially-sliding-vane engine for the purpose of this disclosure. The control system CPU and its connections are not shown in FIG. 15, save for the beginning parts of some signal lines, as being self understanding. The CPU, its input and output ports, and its computer are represented in FIG. 17 in the form of a summary block/flow diagram combination.

The following identifies the various parameters and sequence of events taking place during a typical steady-state piston cycle as previously stated. The externally inputed parameters are:

$P_o$ and $T_o$—air pressure and temperature in the storage tank;

$P_c$—compressed air pressure at a station between the air intake valve and the combustion chamber;

p—setting (% of full power) of the power demand;

MISC. ADJUSTABLE CONSTANTS—as previously discussed and set by the operator;

$P_x$—detected piston location during its stroke;

FUEL TYPE and CYCLE—set as per the operator selection.

The output parameters, and signals therefor, are:

$A_{ai}$—metering area (or position therefor) of the air intake valve for adjusting $\dot{W}_a$ and thus for defining $W_a$;

$P_f$—fuel injection pressure demanded of the fuel system;

$t_f$—starting time of the fuel injection;

$\Delta t_f$—duration of the fuel injection as calculated;

$\delta t_i$—ignition activation timing advance or delay;

$\Delta t_{i\text{-}I}$—ignition activation duration (DAVID-I Cycle mode);

$\Delta t_{i\text{-}II}$—ignition activation duration (DAVID-II Cycle mode);

the combination thereof determining the amount of shaft power available, for a given set of input data.

The computing and decision making steps performed by the computer and its memory wherein information is stored and wherefrom it is retrieved are listed vertically in the sequence they occur. The computer is equipped with a real time clock which serves as time base generator and timing means. Various piston velocities $\dot{P}_x$ are calculated by dividing a set distance by the time elapsed between two piston-location detection signals. As is discussed later, during steady-state engine operation—highway cruising—$W_a$ and $W_f$ need not be calculated for each piston cycle. Therefore a typical piston average velocity $\dot{P}_x$ calculated during any cycle is compared to the corresponding value $\dot{P}_x'$ calculated during the preceding cycle. If $\dot{P}_x=\dot{P}_x'$ and no change in p is indicated, the value is recorded and/or stored for future use and the control values used for the preceding piston cycle may apply again. If $\dot{P}_x\neq\dot{P}_x'$, the calculating and decision making processes proceed and new values of the various parameters are again determined. In the first case, the number of identical piston cycles is tallied and recorded (stored), and indicates the degree of steadiness of operation reached by the engine. My application Ser. No. 789,451 indicates the use which can be made of such information. The duration of the preceding piston cycle and its average velocity during that cycle are computed and stored for future use and/or reference.

The calculation of $W_a$ then takes place as applicable to the subject $n_{th}$ cycle just beginning. $W_f$ is then calculated using either the value of $W_a$ just calculated (DAVID-II mode) or the value determined during the previous cycle (DAVID-I). Based on the fuel type and Cycle mode used, $P_f$ and $\Delta t_f$ are calculated. The completion time of the fuel injection is calculated, starting from the piston cycle beginning ($t_{f(n)}$) indicating the real time during the $n_{th}$ cycle that elapses from t=0—null point passing—to the time at which fuel injection begins). This time is required if an ignition advance is to be provided (DAVID-I Cycle). $\delta t_i$ is determined during the fuel injection. The length of time during which the ignition system is kept energized is determined based on the fuel type and Cycle mode being used. All data above are stored for future reference with the cycle starting real time.

During long periods of time, e.g. long distance highway cruising, the vehicle operator may not adjust p if a long stretch of highway is almost flat. Thus there is no reason for values of $W_a$ and $W_f$ to be automatically calculated and adjusted every piston cycle, save once in a long while, for instance every ten cycles. For that reason, the duration of each one of the ten last piston cycles should be stored, once calculated for future use, and compared so as to detect any drift in combustor regime conditions. Such an approach lightens the computer burden. Also, by averaging a parameter values over several piston cycles, the influence of a source of error such as that created by a piston mispass can be minimized. The possibility of a "hunting" condition developing between the piston motion and its control system is greatly minimized, if compared to the case where only information from the preceding piston cycle is used.

One should also remember that the amount of sideway (or lateral) oscillation of the piston allowed by its axially guiding surfaces is negligible, as earlier mentioned. Thus, if all guiding groove bottom surfaces are equipped with identical ramp systems (or raised shaped bumps), the three corresponding engaging piston stubs will occupy an identical relative position with respect to their respective ramps. The three piston location signals will be simultaneous. In the combustor construction instance where each stub and groove association is used for a different Cycle mode—dual or triple engine-operation mode capability—the timing indications generated by either piston-location detection groove will not vary according to the piston lateral position either.

It is believed that the mechanical decoupling between the motor and the combustion member which characterizes the EC engine of the present invention imposes a greater control burden than does that of conventional IC engines. However, this seemingly extra burden enables such free-piston EC engines to operate in a manner which offers so many benefits that the trade-off of control complexity for engine operation advantages is clearly in favor of the engine of the present invention. All control features required and previously described involve state-of-the-art techniques and/or technology. Because the free piston frequency is ten times or more lower than that of any comparative piston engine, controlling and monitoring the piston motion during each one of its cycle is not farfetched, but both feasible and practical, as the reader familiar with the art will recognize.

Concluding Remarks

As is the case for all forms of EC engines using free-piston combustion member mechanically isolated and decoupled from the motor member, low grade inexpensive fuels can be burned more effectively so as to produce less pollutants. Burning fuels at lower temperatures in some modes of engine operation also lowers the rate of production of $NO_x$. Because no large side forces are exerted on the piston and small lateral forces are never applied abruptly, the axial guiding of the piston is facilitated. It is thus possible to isolate the piston guiding surfaces by a system of high pressure air cushions that can respond instantly to extraneous side loadings to generate restoring forces which automatically oppose any disturbing force soliciting the piston to depart from its centered axial motion.

Therefore, moving surfaces of the piston never come in contact with the fixed sleeve guiding surfaces. This results in the elimination of the needs for cooling and lubrication. Wear of adjacent surfaces moving relatively to one another is also eliminated. Theoretically, such free piston could operate forever. The cost of providing such air cushions in term of engine efficiency loss is more than made up by efficiency gains resulting from the eliminations of cooling, lubrication and wear. The absence of valves and attendant moving parts simplifies construction and also eliminates the source of potential problems and/or malfunctions. The automatic registering of fixed ports to perform the valving functions insures reliable and repeatable timings of "valve" opening and closing without moving parts.

The possibility of adapting the engine operation mode to various fuels and/or to corresponding optimum thermodynamic cycles with simple adjustments of knobs and/or dials gives the EC engine of the present invention a unique flexibility of use and application. It is thought that this EC engine and many of its attendant advantages will be understood from the foregoing description and it will be apparent that various changes may be made in the form, construction and arrangement of the parts thereof without departing from the spirit and scope of the invention or sacrificing any and all of its material advantages, the form hereinbefore described being merely a preferred examplary embodiment thereof.

Having thus described my invention, I now claim:

1. An external combustion engine comprising:

a combustion member including a sleeve having an end closure and an ignition means at each end thereof, inlet and outlet valving means for introducing compressed air and exhausting combusted gases through valving openings, and a free piston mounted in the sleeve for sliding reciprocating axial motion between the end closures and defining a combustion chamber between each end closure and a corresponding end of the piston;

means for compressing the air and introducing the compressed air in the combustion chambers through the inlet valving means;

means for receiving and expanding the exhausting combusted gases to drive the air compressing means and a power delivery member;

means for introducing fuel for burning in the combustion chambers;

means for detecting the axial location of the piston as it reciprocates and for generating pneumatic signals representative of the piston location and axial motion direction;

means for controlling the fuel introduction means and the ignition means in response to the pneumatic signals;

means for automatically maintaining the piston centered and aligned within the sleeve by using pressurized air cushion; and means for automatically regulating the air pressure inside the cushions in response to piston radial displacements so as to control and adjust radial piston/sleeve relative displacements;

wherein: (1) the inner cylindrical surface of the sleeve wall and the piston outer cylindrical surface are both equipped with associated and cooperating structural means for imparting a predetermined guided rotational motion to the piston as it reciprocates axially, and (2) the thus coordinated axial and rotational motions of the piston provide the means for automatically controlling the openings and closings of the inlet and outlet valving means.

2. An external combustion engine according to claim 1 wherein the associated and cooperating structural means of the piston and of the sleeve further comprises:

a plurality of guiding elements connected to the sleeve wall and located substantially halfway between the end closures;

a plurality of corresponding grooves formed in the piston wall for receiving said guiding elements;

wherein the guiding elements are constructed to engage the grooves, one element positioned in each groove, so as to singularly associate the rotational and axial motions of the piston.

3. An external combustion engine according to claim 2 wherein the piston rotational motion resulting from its axial motion as imparted by the cooperating structural means causes any and all points on the piston cylindrical outer surface to follow substantially elliptically contoured paths with respect to the fixed sleeve cylindrical inner surface, said elliptical paths having the same length and being identically shaped, and the long axes of the quasi ellipses thus formed being parallel to the sleeve axis and defining the direction of the piston axial motion.

4. An external combustion engine according to claim 3 wherein the combustion member further includes a hollow shaft connecting and extending axially from the end closures, said shaft traversing the piston through a central bore extending axially between the two end surfaces of the piston and cooperating with the bore surface to form a plurality of high pressure air cushion pads between the shaft external surface and said bore inner surface so as to construct a pressurized air journal for supporting the piston radially and thus preventing the piston and the sleeve from making direct physical contact during the piston dual motions.

5. An external combustion engine according to claim 4 wherein automatic air pressure regulating means is provided for adjusting the air pressure level in the pads so as to: (1) increase said air pressure in a pad when the two cylindrical surfaces of opposite faces of said pad come closer, and (2) decrease said air pressure in a pad when the distance between the two cylindrical surfaces of opposite faces of said pad increases;

whereby the air pressure in one pad increases while the air pressure in the pad located diametrically opposite concomitantly decreases, thereby generating a net resulting restoring force on the piston which then opposes those piston lateral displacements which cause said air pressure variations to be generated.

6. An external combustion engine according to claim 5 wherein the combustion member is constructed for providing clearance between the sleeve wall inner cylindrical surface and the piston wall outer cylindrical surface that is larger than the clearance between the supporting shaft outer surface and sliding lands formed on the piston bore wall and which define the outer side boundaries of the air cushion pads;

whereby the piston wall outer cylindrical surface is constantly prevented from ever contacting the sleeve wall inner surface when the engine operates.

7. An external combustion engine according to claim 6 wherein the high pressure air forming the air cushion pads and the air escaping therefrom are both introduced and evacuated through means located in the hollow support shaft structure.

8. An external combustion engine according to claim 1 wherein the opening and closing of the inlet and outlet valving means are located on the corresponding sliding surfaces of both piston and sleeve, whereby the imposed coordination of the rotational and axial motions of the piston with respect to the fixed sleeve causes valving ports to register timely, sequentially and automatically according to a predetermined and set program.

9. An external combustion engine according to claim 1 wherein a cylindrical structure protruding inwardly from each end closure and supporting one corresponding end of the hollow shaft cooperates with a cylindrical cavity located at each end of the piston bore and in which the cylindrical structure engages at the end of each piston stroke, said cylindrical structure and cavity having substantially the same diameter but larger than the outer diameter of the hollow support shaft, and further comprising:

a clamping system located inside the cylindrical structure including a plurality of retaining hooks for holding the piston, actuating means for advancing and retracting said hooks and means for steadily guiding and securing said hooks; and a groove located in the piston wall forming said cavity for cooperating with the hooks which are shaped and constructed to engage said groove in their advanced position;

whereby a quantity of combusted gas becomes trapped between one piston end and the corresponding end closure each time the piston approaches the end of its stroke as the piston cavity groove passes by the retracted hook ends, thereby facilitating the bouncing back of the piston and allowing the hooks to engage the groove when actuated and as the piston cavity disengages the protruding structure in the early phase of the following piston stroke, said clamping system being used only during the starting and stopping phases of the combustion member operation.

10. An external combustion engine according to claim 9 wherein the structural means for imparting its rotational motion to the piston and the end closure protruding structure cooperate with means provided for adjusting the peak pressure reached by the trapped gas at the end of the piston stroke so as to prevent the piston end from contacting the sleeve end closure, to insure that the piston always bounces back in the correct direction and to stop any oscillation of the piston about a transversal axis which may have previously been initiated.

11. An external combustion engine according to claim 7 wherein high pressure air is introduced in the pads at a pressure substantially higher than that of the compressed air introduced in the combustion member and the air is caused to leave the pads at a pressure slightly higher than that of the combusted gas in the combustion chambers so as to insure that the flow of the high pressure air into and out of the pads is not affected by the piston dual motions inside the sleeve, whereby:

the air-pad generated restoring forces applied transversally on the piston are always larger than and opposed to the transversal resultant forces exerted by the compressed air and the combusted gas onto the piston cylindrical outer surface;

the air leaving the air pads may be introduced directly into the compressed air flow entering the combustion member; and combusted gas is prevented from leaking into the air pads at all times during engine operation.

12. An external combustion engine according to claim 11 wherein the journal formed by the air cushion pads eliminates physical contact between cooperating sliding surfaces of the piston and of the sleeve, thereby eliminating solid friction during most of the piston stroke while the piston travels at its highest speed, whereby: (1) the need for lubrication is eliminated, (2) cooling of the piston is not required, and (3) production of abrasive solid particles resulting from sliding surface wear is eliminated.

13. An external combustion engine according to claim 3 wherein each guiding element is a hollow stub ducting high pressure air to its end facing the bottom surface of the groove which said stub engages, said bottom surface having short raised shaped bumps located at set intervals along the length of said groove, constructed and positioned with respect to the stub end so as to form a variable size restricting orifice each time the stub passes by a bump without making physical contact therewith, a source of air at substantially constant high pressure is provided for supplying the stub with air, a fixed size restricting orifice is located between the air source and the stub end, the variations of the air pressure between the fixed size restricting orifice and the stub end are detected by a pressure sensor, whereby:

the sensed pressure rises abruptly when the stub passes over a raised bump in the proper direction and falls slowly as the stub completes its passage, the sequence of rapid pressure rise followed by a slow fall being an indication of said direction;

the sensor generates an electrical signal representative of said pressure rises and falls indicating thereby the location and the direction of the piston; and the sensor signal indicates the time at which said bump passed by the stub end in comparison with the time at which the preceding bump in said groove passed by, thereby enabling a central processing unit to determine the piston average velocity between said times.

14. An external combustion engine according to claim 5 and which further comprises:

a tank for temporarily storing compressed air and combusted gas and in which the air and the gas are channelled to flow in parallel directions without mixing so as to cause heat to be exchanged during said flows between the combusted gas and compressed air prior to their leaving said tank;

an air intake valve located between the storage tank and the combustion member for adjusting the amount of compressed air introduced in the combustion chamber; and a fuel delivery system for supplying and adjusting the fuel amount to be introduced in the combustion chamber during each of the piston stroke and cycle.

15. An external combustion engine according to claim 14 wherein the inlet and outlet valving means is used solely for automatically coordinating the timely opening and closing of the valving ports as a function of piston location only, whereby adjusting the air intake valve concomitantly with adjusting the amount of fuel delivered in the combustion chamber determines the amount of energy generated during a piston cycle, thereby defining the power level which the engine power delivery member may yield for a given cycle frequency of the piston.

16. An external combustion engine according to claim 15 wherein the level of the power to be delivered by the engine at any time is determined by a control system comprising:

a central processing unit including input ports for receiving signals for processing, a computer having electronic means for handling, calculating and storing data received and processed according to an established set of instructions, and output ports for sending signals to actuating means of the engine associated operating equipment;

means for determining the location and direction of the piston using the signals from the piston detection pressure sensor;

means for detecting the air pressure upstream and downstream of the air intake valve, and the temperature of said air;

means for generating signals representative of the air data thus detected;

means for setting the amount of opening of the air intake valve in response to an engine operator's input;

means for calculating the amount of air flowing through said air intake valve opening at any time;

means for computing the amount of air in each one of the combustion chambers during each one of the piston cycles; and means for calculating the amount of fuel to be injected in said combustion chamber so as to always maintain a preset fuel to air ratio;

whereby the burning of the fuel generates peak combustion temperatures which always remain below a pre-established level so as to limit the production of pollutants in the combusted gases of the engine exhaust.

17. An external combustion engine according to claim 16 wherein the engine power control system further includes:

means operated by the engine operator for establishing the engine power level requirement and for generating a signal representative of said requirement;

means for receiving and processing said signal to calculate the fuel/air ratio programmed for said power level;

means for calculating the fuel injection pressure and duration so as to adjust the amount of fuel introduced in the combustion chamber during each piston cycle;

means for calculating the time of initiation of the fuel injection;

means for calculating the time of initiation of the fuel ignition;

means for storing the data generated by the computer for use at a later time as and when needed; and means for inputing, storing and processing engine operating data such as adjustable constants, set constants and type of engine operation mode, during engine operation and whilst the engine is turned off, as the case may warrant and as applicable.

18. An external combustion engine according to claim 5 wherein a plurality of additional short air cushion pads are located on the bore surface near the ends thereof and are constructed and connected to a high pressure air source in a manner such that a resisting torque about a transversal axis of the piston is developed and exerted thereon when the piston is solicited to tilt about said transversal axis, said torque opposing the oscillating piston displacement which said tilting initiated, thereby constituting a restoring torque applied onto the piston any time the piston longitudinal axis angularly departs from the position of the sleeve longitudinal axis with which it nominally coincides, whereby any and all angular misalignments between the piston and the sleeve are automatically and constantly corrected as the piston proceeds in its reciprocating sliding dual motions.

19. An external combustion engine according to claim 3 wherein the combustion member further includes a plurality of shallow cavities located on the piston outer cylindrical surface and distributed substantially evenly about said surface so as not to spatially interfere with other openings located on the piston and on the sleeve, said cavities thus facing the inner cylindrical surface of the sleeve and being confined within walls forming a plurality of lands on the piston surface and level therewith, each one of said cavities being supplied with high pressure air flowing through a fixed size restricting orifice and forming an air cushion between the piston and the sleeve, the area defined by the cavity land contour and the distance between piston and sleeve cooperating surfaces forming a variable size restricting orifice in series with the fixed size orifice, the air cushion pad thus formed applying an elemental force normal to the piston surface and which strives to move the piston away radially in the force direction, thus forming means for centering the piston, whereby:

a plurality of air cushion pads is thus formed by the plurality of cavities, thereby constructing a pressurized air journal;

the areal distribution and sizes of the air cushion pads are such that at rest, when the piston and sleeve axes coincide and are in a centered position, the resultant force of all these elemental forces is nil and no action is exerted on the piston; and a non-axial displacement of the piston results in a resultant force exerting an action on the piston which opposes said displacement and attempts to return the piston to its original nominal centered position at any location during its axial stroke.

20. An external combustion engine according to claim 19 wherein the high pressure air supplied to the fixed size restricting orifice of each air cushion pad is ducted from a compressor which raises the pressure of a quantity of compressed air to a higher constant pressure level to a hole in the sleeve wall, said hole continuously venting openly into a corresponding cooperating air cushion pad space for any and all positions assumed by the free piston as it reciprocates during its dual motions.

21. An external combustion engine according to claim 19 wherein the high pressure air supplied to the fixed size restricting orifice of each air cushion pad is ducted from a compressor which raises the pressure of a quantity of compressed air to a higher constant pressure level to a tube centrally located inside the sleeve and extending between the two end closures through the piston, said piston having a bore centrally located for receiving said tube and of diameter larger than that of the tube, the association of tube and bore forming an annular space closed at both ends by a sliding seal mounted of the piston, the internal volume of the tube being connected to the annular space by a plurality of holes located substantially midway between the tube ends, and the high pressure air ducting inside the piston further comprising:

a plurality of ducts connecting the annular space to the air cushion pads, one singular duct for each pad; and a plurality of fixed size restricting orifices, one singular orifice installed in each duct;

whereby: (1) the air pressure in the annular space remains constant for and all axial, rotational and angular positions of the piston, singularly and in any combination thereof, (2) the air pressure inside each air cushion pad is unaffected by the air pressure existing in the other air cushion pads, (3) the air pressure inside each air cushion pad depends singularly and only upon the area of the variable size orifice formed by the confining lands of said pad and the facing sleeve inner surface (4) the radial thickness of the annular space is much larger than the clearance between the piston outer surface and the sleeve inner surface, thereby preventing the piston bore surface from ever contacting the tube outer surface, and (5) the only friction imposed on the piston is that which results from the sliding friction of the seals on the outer surface of the central tube.

22. An external combustion engine according to claim 17 wherein three sets of guiding elements and corresponding grooves are substantially uniformly distributed around the piston cylindrical wall, the raised shaped bumps located on the bottom surfaces of said grooves being distributed differently in each groove in a manner such that the set of signals generated by each groove and associated piston guiding stub during the piston motion are timed differently and correspond to a different set of piston locations along its stroke, each one of said set of piston locations corresponding to timing positions of the piston which are optimally placed for generating the especially timed signals needed for a specific mode of operation of the engine combustion member, thereby enabling the engine to operate according to one of three possible and different modes as chosen by the engine operator, means being provided in the central processing unit for selecting the set of signals to be processed for each one of said operation modes.

23. An external combustion engine according to claim 17 wherein means for temporarily increasing the magnitude of the signal generated by the means operated by the engine operator for establishing the engine power requirement is included in the control system so as to decrease the response time of the engine to a power increase demanded by the operator.

24. An external combustion engine according to claim 17 wherein a check valve is provided between the compressed air supply and the compressed air inlet valving means so as to allow the pressure of the combusted gas to exceed the supply pressure of the compressed air whilst the air inlet valving means is still open, thereby enabling the engine to operate according to a thermodynamic cycle akin to the OTTO Cycle and variations thereof.

25. An external combustion engine according to claim 22 wherein the piston axial motion data generated and stored during the preceding piston stroke is used by the central processing unit to predetermine the amounts of air and fuel which are to be introduced in a combustion chamber during the subsequent piston cycle so as to provide more time for adjusting the amount of fuel to be injected in said combustion chamber.

* * * * *